US007828611B2

(12) United States Patent
Nakamura et al.

(10) Patent No.: US 7,828,611 B2
(45) Date of Patent: Nov. 9, 2010

(54) TERMINAL FITTING

(75) Inventors: Keiichi Nakamura, Yokkaichi (JP); Takumi Hiraishi, Yokkaichi (JP); Hiroko Kato, Yokkaichi (JP); Masami Sakai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/504,476

(22) Filed: Jul. 16, 2009

(65) Prior Publication Data

US 2010/0035482 A1 Feb. 11, 2010

(30) Foreign Application Priority Data

| | | |
|---|---|---|
| Aug. 7, 2008 | (JP) | 2008-203851 |
| Aug. 27, 2008 | (JP) | 2008-218190 |
| Aug. 27, 2008 | (JP) | 2008-218782 |
| Sep. 26, 2008 | (JP) | 2008-248941 |

(51) Int. Cl.
*H01R 4/10* (2006.01)

(52) U.S. Cl. ..... 439/877

(58) Field of Classification Search ..... 439/877, 439/949, 882

See application file for complete search history.

(56) References Cited

U.S. PATENT DOCUMENTS

| | | | | |
|---|---|---|---|---|
| 4,341,921 | A | 7/1982 | Simpson | |
| 5,254,022 | A * | 10/1993 | Stuart | 439/877 |
| 5,516,311 | A | 5/1996 | Maejima | |
| 5,522,739 | A | 6/1996 | Axelsson | |
| 7,402,089 | B1 | 7/2008 | Myer et al. | |
| 2002/0119700 | A1 | 8/2002 | Murakami | |

FOREIGN PATENT DOCUMENTS

| | | |
|---|---|---|
| JP | 2003-317817 | 7/2003 |
| JP | 2004-303526 | 10/2004 |
| JP | 2005-222815 | 8/2005 |

* cited by examiner

*Primary Examiner*—Phuong K Dinh
(74) *Attorney, Agent, or Firm*—Gerald E. Hespos; Michael J. Porco

(57) ABSTRACT

A terminal fitting (20A) to (20D, 110, 220, 320) is provided with a connecting portion (21, 121, 211, 311) to be connected with a mating terminal, a wire barrel (27, 126, 232, 312) to be crimped into connection with an end portion of a conductor (11, 111, 222, 322) exposed by removing an insulation coating (12, 112, 223, 323) of a wire (10, 110, 220, 320) in which the conductor (11, 111, 222, 322) made up of twisted strands is covered by the insulation coating (12, 112, 223, 323), and a restriction (30, 32, 35, 133, 218, 318) capable of restricting the widening of a leading end side of the conductor (11, 111, 222, 322) by projecting from a wire barrel (27, 126, 232, 312) side toward the connecting portion (21, 121, 211, 311).

14 Claims, 22 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2003-317817 discloses technology using an aluminum conductor instead of a conventional conductor made of copper alloy for a lighter wire in a connecting structure for a terminal fitting and a wire.

Japanese Unexamined Patent Publication No. 2005-222815 discloses a terminal fitting in which a substantially rear half thereof is a wire crimping portion in the form of open barrels. A front end region of the wire crimping portion defines a wire barrel to be crimped into connection with a conductor of a wire, and a rear end region thereof defines an insulation barrel to be crimped into connection with an insulated part of the wire. The conductor is a twisted wire formed by twisting plurality thin metal wires and a front end portion of the conductor projects forward from the front end of the wire barrel.

Japanese Unexamined Patent Publication No. 2004-303526 discloses a terminal fitting with connecting portion to be connected with a mating terminal and a wire barrel behind the connecting portion. The wire barrel has two crimping pieces to be crimped into connection with a core exposed at the end portion of the wire and at a position so that the leading end of the core projects forward from the crimping pieces to be connected entirely with the core.

The crimp height of the above-described terminal fitting may be set low to avoid interference with a retainer or the like. However, the thin twisted conductive wires of the conductor then are loosened up before the wire barrel portion due to the tightening strength to the wire barrel portion and the leading ends of the thin loosened metal wires are deformed to be widened. If this occurs, the thin metal wires deformed to widen may interfere with the retainer.

Measures must be taken when using the aluminum conductor for a lighter wire or the like, as disclosed in Japanese Unexamined Patent Publication No. 2003-317817, to prevent an increase of contact resistance due to the difficulty of removing an oxide film of the aluminum conductor as compared with a copper conductor or other reason. One of these measures is to crimp the wire barrel more strongly into connection with the conductor. However, a stronger crimping of the wire barrel into connection with the conductor widens the leading end of the conductor more notably and there has been a demand for elaboration to prevent this.

The invention is developed in view of the above situation and an object thereof is to prevent a leading end portion of a conductor from being widened.

SUMMARY OF THE INVENTION

The invention relates to a terminal fitting with a connecting portion to be connected with a mating terminal. The terminal fitting also has at least one wire barrel to be crimped, bent, folded or deformed into connection with an end portion of a conductor at least partly exposed by removing an insulation coating of a wire. The terminal fitting further has at least one restriction capable of restricting the widening and/or deflection of a leading end of the conductor by projecting from a side of the wire barrel toward the connecting portion.

The leading end of the restriction may be located before the leading end of the conductor for more reliably preventing a widening deformation of the leading end of the conductor.

The restriction may be continuous with the wire barrel. Thus, the widening of the leading end of the conductor can be suppressed by a relatively simple shape.

The wire barrel may include a base plate that extends from the connecting portion and on which the end portion of the wire is to be placed and two crimping pieces that stand up from the base plate. The end portion of the conductor may be connected while being surrounded by the base plate and the crimping pieces. The restriction may be connected with only one or both crimping pieces. Loads acting on connected parts of the crimping pieces and the restricting portion can be reduced if the restricting portion is continuous with both crimping pieces. On the other hand, a forming error is less likely while forming the restriction if the restriction is connected with only one of the crimping pieces.

The restriction may be continuous with an intermediate part of the crimping piece excluding a projecting end portion and an end portion toward the base plate. Accordingly, the restriction will not be bent more than necessary as the crimping pieces are crimped.

A coupling may be formed between the wire barrel and the connecting portion. The leading end of the conductor may be positioned in the coupling, and the restriction may be continuous with the coupling. With this construction, external matter will not enter through a clearance between the restriction and the coupling to contact the conductor.

The restriction and/or the base plate may be formed with at least one window that enables a part of the conductor to be seen. Accordingly, a proper connected state of the conductor can be confirmed by seeing the conductor through the window after the wire barrel is crimped into connection with the conductor.

The window may be closer to the connecting portion than to the wire barrel. According to such a construction, whether the leading end of the conductor projects more toward the connecting portion than the crimping pieces can be confirmed visually through the window from the outside after the wire barrel is crimped into connection with the conductor. The leading end of the end portion of the conductor may be hidden behind the restriction. However, the window in the base plate advantageously enables the connected state of the end portion of the conductor to be seen from the base plate.

The conductor and the wire barrel may be made of different kinds of materials, preferably metals, and the restriction may be formed to cover the leading end of the conductor. Electrolytic corrosion may occur if an electrolyte, such as moisture, is present in a connected part of the conductor and the wire barrel when the conductor and the wire barrel are made of different kinds of metals, i.e. both metals may be dissolved as ions in the electrolyte to cause an electrochemical reaction so that corrosion progresses. More particularly, the electrolyte is likely to deposit on the part of the conductor exposed from the wire barrel and electrolytic corrosion is likely to occur in this part. However, the restriction of the invention covers the leading end of the conductor and prevents the deposition of the electrolyte. Consequently electrolytic corrosion resulting from the deposition of the electrolyte can be prevented.

At least one insulation barrel to be crimped into connection with the insulation coating of the wire may be positioned at a side of the wire barrel opposite to the connecting portion. Furthermore, the wire barrel may be formed with at least one eave extending toward the insulation barrel to overlap with the outer circumferential surface of the insulation coating.

Accordingly, an electrolyte will not be deposited on the conductor in a clearance between the wire barrel and the insulation barrel can be prevented.

An extending end of the eave may be continuous with the insulation barrel. Thus, electrolyte cannot penetrate into a clearance between the eave and the insulation barrel.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
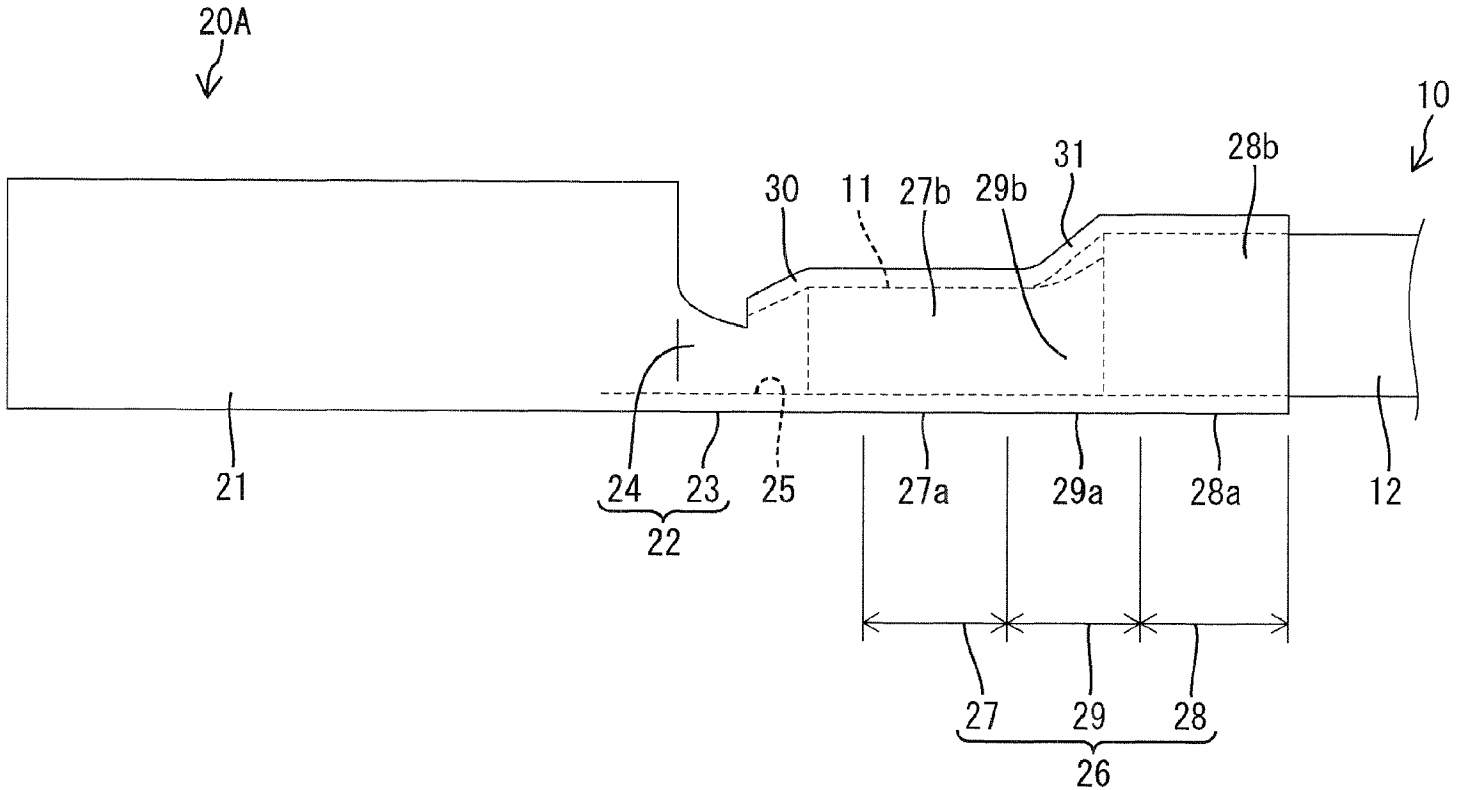
FIG. 1 is a side view of a terminal fitting according to a first embodiment.
Figure 2:
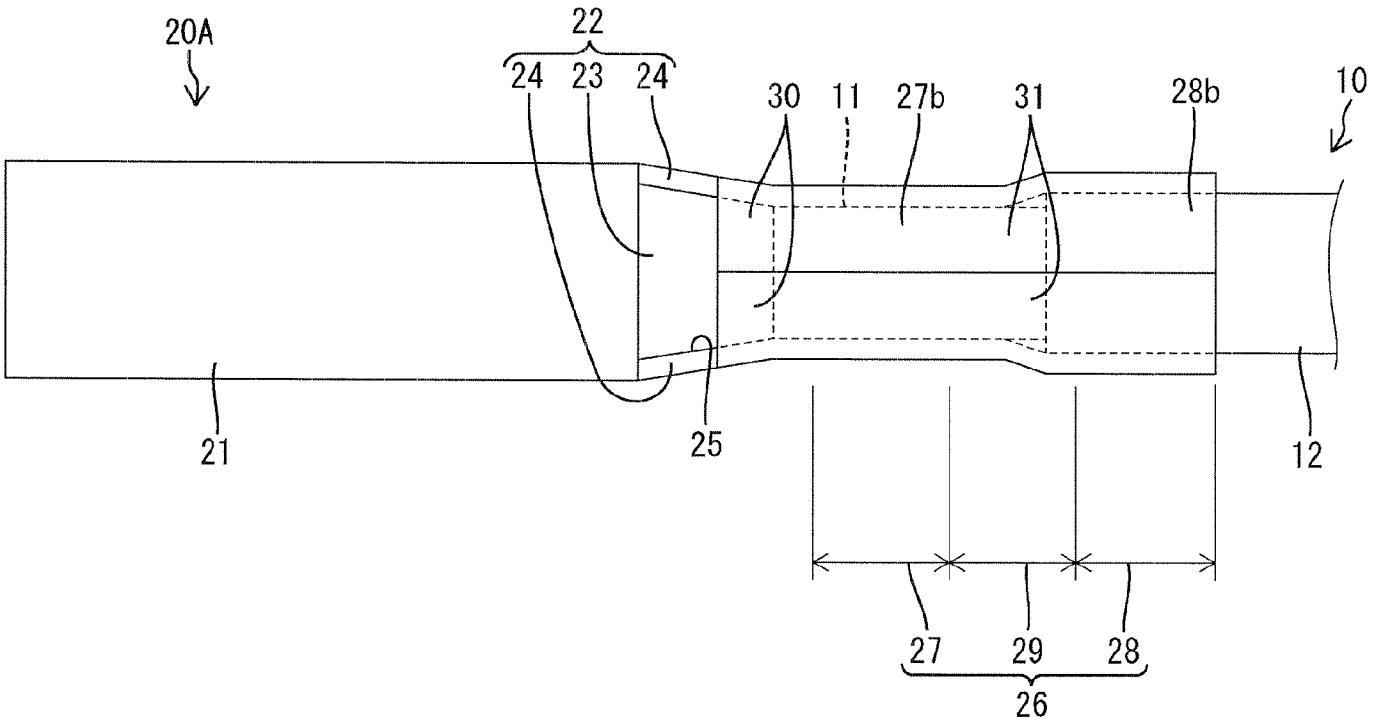
FIG. 2 is a plan view of the terminal fitting of FIG. 1.

A first embodiment of the invention is described with reference to FIGS. 1 and 2. A wire 10 of this first embodiment comprises a conductor 11 formed by twisting a plurality of thin conductive metal thin wires and an insulation coating 12 surrounding the conductor 11. A portion of the insulation coating 12 is removed beforehand to expose a front end portion of the conductor 11 as preparation for connection with a terminal fitting 20A. The conductor 11 preferably is aluminum or aluminum alloy, which has higher rigidity than copper and lower electrical conductivity than copper.

The terminal fitting 20A is made of a conductive material such as a metal (preferably copper or copper alloy) that is different from the material of the conductor 11 and that initially is in the form of a plate. The plate is cut or punched out to a specified shape and is bent, folded and/or embossed to form the terminal fitting 20A shown in FIGS. 1 and 2. The terminal fitting 20A is a female terminal fitting, and has a rectangular tubular connecting portion 21 at a front end thereof (left end in FIGS. 1 and 2). The connecting portion 21 is of the known form and functions as connection means for connecting with a long narrow tab of a mating male terminal (not shown).

A coupling 22 is substantially continuous with the rear end of the connecting portion 21. The coupling 22 comprises a substantially flat base plate 23 continuous with the base wall of the connecting portion 21 and two substantially laterally symmetrical side walls 24 projecting up at substantially right angles from the opposite left and right sides of the base plate 23. The height of the side walls 24 is less than the height of the connecting portion 21. An upwardly open accommodation space 25 is formed by the coupling 22.

A wire crimping portion 26 is substantially continuous with the rear end of the coupling 22 and can be crimped, bent or folded into connection with the front end portion of the wire 10. A wire barrel 27 is defined at a front part of the wire crimping portion 26 and an insulation barrel 28 is defined at a rear end part of the wire crimping portion 26. A link 29 joins the rear end of the wire barrel 27 and the front end of the insulation barrel 28. The link 29 has a base plate 29*a* and two side plates 29*b* that project up from the opposite left and right sides of the base plate 29*a*.

The wire barrel 27 has a base plate 27*a* and two substantially laterally symmetrical crimping pieces 27*b* extend from the opposite left and right edges of the base plate 27*a*. The crimping pieces 27 can be crimped, bent or folded into connection with the front end portion of the conductor 11. The conductor 11 connected with the wire barrel 27 is pressed over substantially the entire circumference by the bottom plate 27*a* and the crimping pieces 27*b*, and is fixed electrically to the wire barrel 27 by a fixing force resulting from this pressing. In a crimped or connected state, the front end portion of the conductor 11 projects forward from the front end edges of the crimping pieces 27*b* and is at least partly located in the accommodation space 25 in the coupling 22.

The insulation barrel 28 is crimped, bent or folded into connection with a part of the front end portion of the wire 10 covered by the insulation coating 12. The insulation barrel 28 has a base plate 28*a* and two substantially laterally symmetrical crimping pieces 28*b* that extend from the lateral left and right edges of the base plate 28*a*. The wire 10 connected with the insulation barrel 28 is pressed over substantially the entire circumference by the bottom plate 28*a* and the crimping pieces 28*b*, and is fixed to the insulation barrel 28 by a fixing force resulting from this pressing.

A front end portion of the insulation coating 12 projects forward from the front end edges of the crimped crimping pieces 28*b* and is located before the rear end edges of the crimping pieces 27*b*. A rear end portion of the exposed part of the conductor 11 and the front end portion of the insulation coating 12 are located in the linking portion 29 between the crimping pieces 27*b* and the crimping pieces 28*b*.

Restrictions 30 project unitarily forward from the front end of the wire barrel 27 to cover the outer circumferential surface of the front end portion of the conductor 11 and hence to restrict a widening deformation of the leading end of the conductor 11. The restrictions 30 are continuous with the front end edges of the crimping pieces 27*b* of the wire barrel 27 and with the upper end edges of the side walls 24 of the coupling 22. Additionally, the restrictions 30 at least partly cover the front end surface of the conductor 11 from the front or along an axial direction of the terminal fitting 20A.

The wire crimping portion 26 is formed unitarily with eaves 31 that extend substantially backward from the rear ends of the crimping pieces 27*b* of the wire barrel 27 and substantially onto the outer circumferential surface of the front end portion of the insulation coating 12. The eaves 31 are continuous with the rear end edges of the crimping pieces 27*b*, the front end edges of the crimping pieces 28*b* and the upper end edges of the side plates 29*b* of the linking portion 29. Accordingly, the conductor 11 and the insulation coating 12 are covered substantially completely without being exposed to the outside between the wire barrel 27 and the insulation barrel 28.

A conventional conductor that projects forward from the front end of a wire crimping portion is exposed and electrolyte, such as water, is likely to deposit thereon. Therefore electrolytic corrosion has occurred easily in this part. In contrast, the part of the conductor 11 projecting forward from the front end of the wire crimping portion 26 of the first embodiment is covered by the restrictions 30. Thus, there is a strongly reduced likelihood or no likelihood of electrolyte deposits on the front end portion of the conductor 11 forward from the wire barrel 27. Therefore, electrolytic corrosion resulting from the deposition of the electrolyte is reduced significantly or prevented. Additionally, the leading ends of the restrictions 30 are before the leading end of the conductor 11 to prevent a widening deformation of the leading end of the conductor 11.

Further, the restrictions 30 are continuous with the wire barrel 27. Thus, the widening deformation of the leading end of the conductor 11 is suppressed by a relatively simple shape.

The rear ends of the restrictions 30 are continuous with the crimping pieces 27*b* and the lateral edges of the restrictions 30 are continuous with the side walls 24 of the coupling 22 in the first embodiment. Thus, the entry of the electrolyte is prevented reliably between the restrictions 30 and the crimping pieces 27*b* and between the restrictions 30 and the side walls 24. Further, external matter other than the electrolyte cannot enter between the restrictions 30 and the side walls 24 and cannot contact the conductor 11.

The eaves 31 are between the wire barrel 27 and the insulation barrel 28. More particularly, the front ends of the eaves 31 are continuous with the crimping pieces 27*b*, the rear ends of the eaves 31 are continuous with the crimping pieces 28*b* and the lateral edges of the eaves 31 are continuous with the side plates 29*b*. Thus, the eaves 31 cover the conductor 11 and the insulation coating 12 between the wire barrel 27 and the insulation barrel 28 and reliably prevent entry of the electrolyte.

Figure 3:
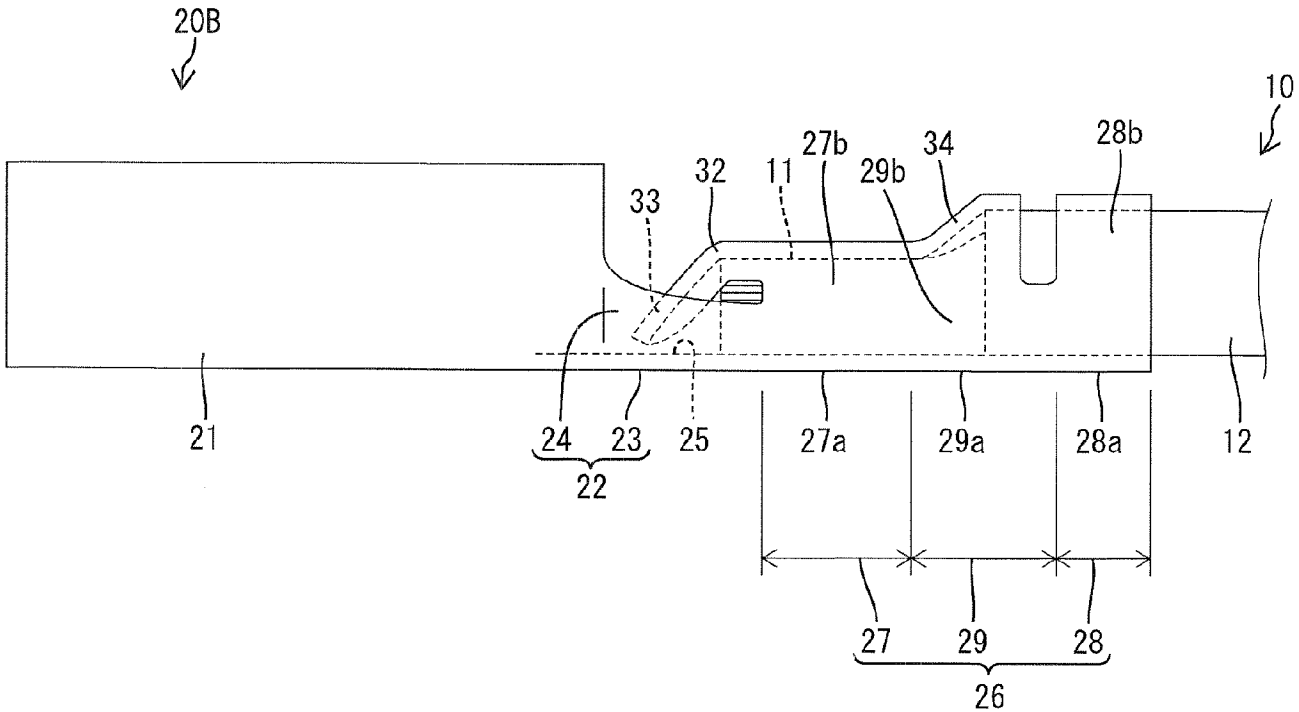
FIG. 3 is a side view of a terminal fitting according to a second embodiment.
Figure 4:
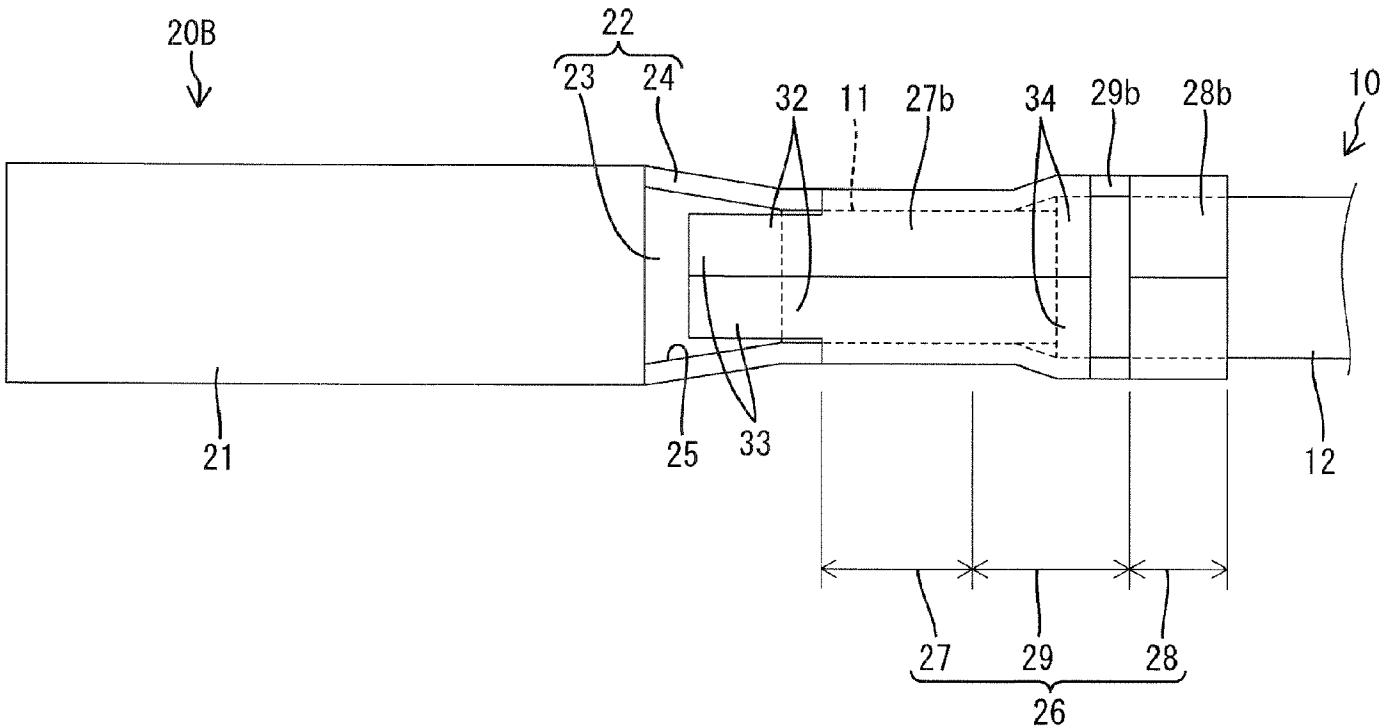
FIG. 4 is a plan view of the terminal fitting of FIG. 3.

A second embodiment of the invention is illustrated in FIGS. 3 and 4. A terminal fitting 20B of the second embodiment differs from the first embodiment with respect to the restrictions 32 and eaves 34. Other elements are the same as or similar to the first embodiment. These similar elements are identified by the same reference numerals, but are not described.

The restrictions 32 of the second embodiment extend substantially forward from the front end edges of the crimping pieces 27*b* of a wire barrel 27, but are not connected directly with side walls 24 of the coupling 22. The restrictions 32 project forward to cover the outer circumferential surface of the front end portion of the conductor 11 for restricting a widening deformation of a front end portion of a conductor 11. The restrictions 32 also cover the front end surface of the conductor 11 from the front along an axial direction of the terminal fitting 20A. Inclinations 33 are formed at the front end parts of the restrictions 32 and incline to approach a base plate 23 toward the front. The inclinations 33 are between the left and right side walls 24, and front end parts of the inclinations 33 are accommodated in an accommodation space 25 and at least partly cover the conductor 11 from the front. On the other hand, the eaves 34 extend back from the rear ends of the crimping pieces 27*b* to overlap with the outer circumferential surface of a front end portion of an insulation coating 12. The eaves 34 are substantially continuous with the rear end edges of crimping pieces 27*b* and front end regions of the upper end edges of side plates 29*b* of the link 29, but do not connect directly with crimping pieces 28*b*. Therefore, a part of the insulation coating 12 is exposed between the rear ends of the eaves 34 and the crimping pieces 28*b*.

Figure 5:
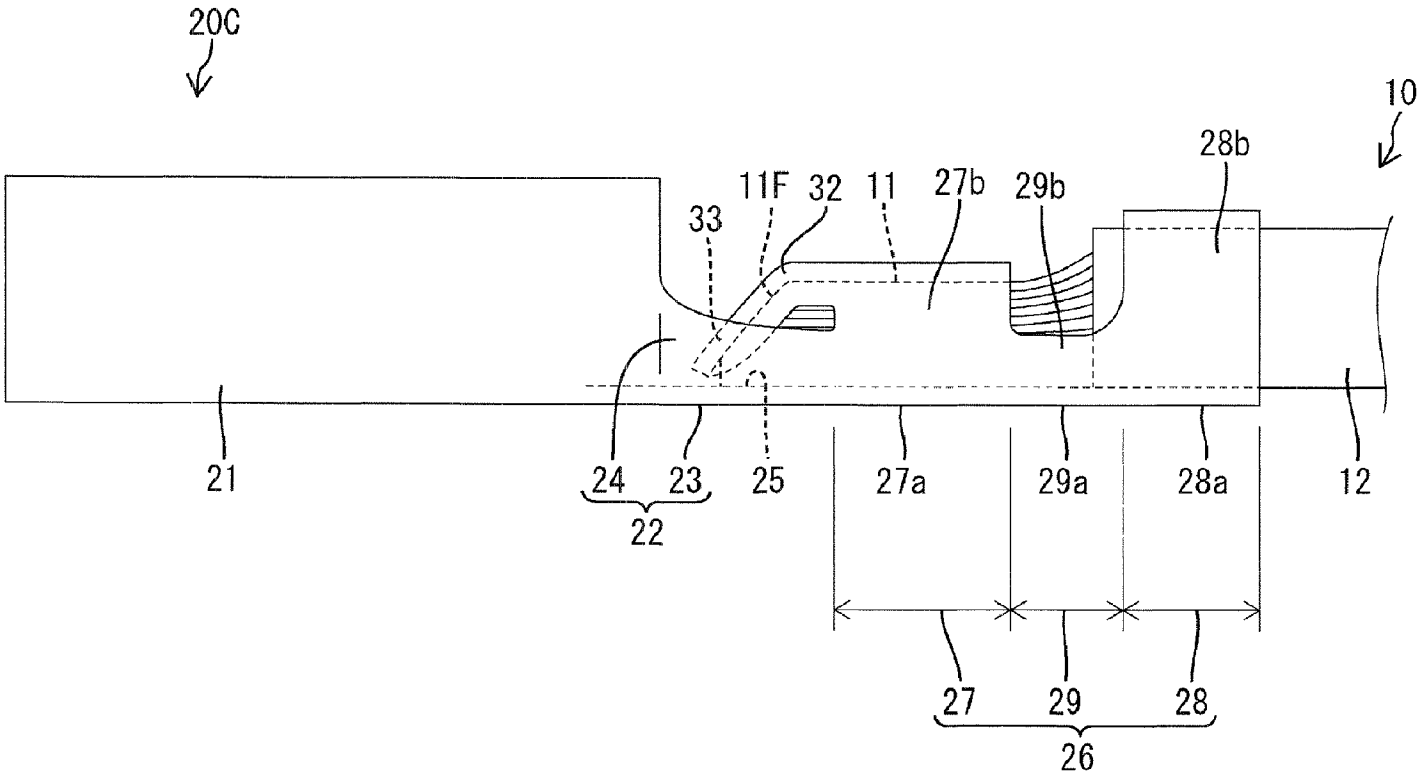
FIG. 5 is a side view of a terminal fitting according to a third embodiment.
Figure 6:
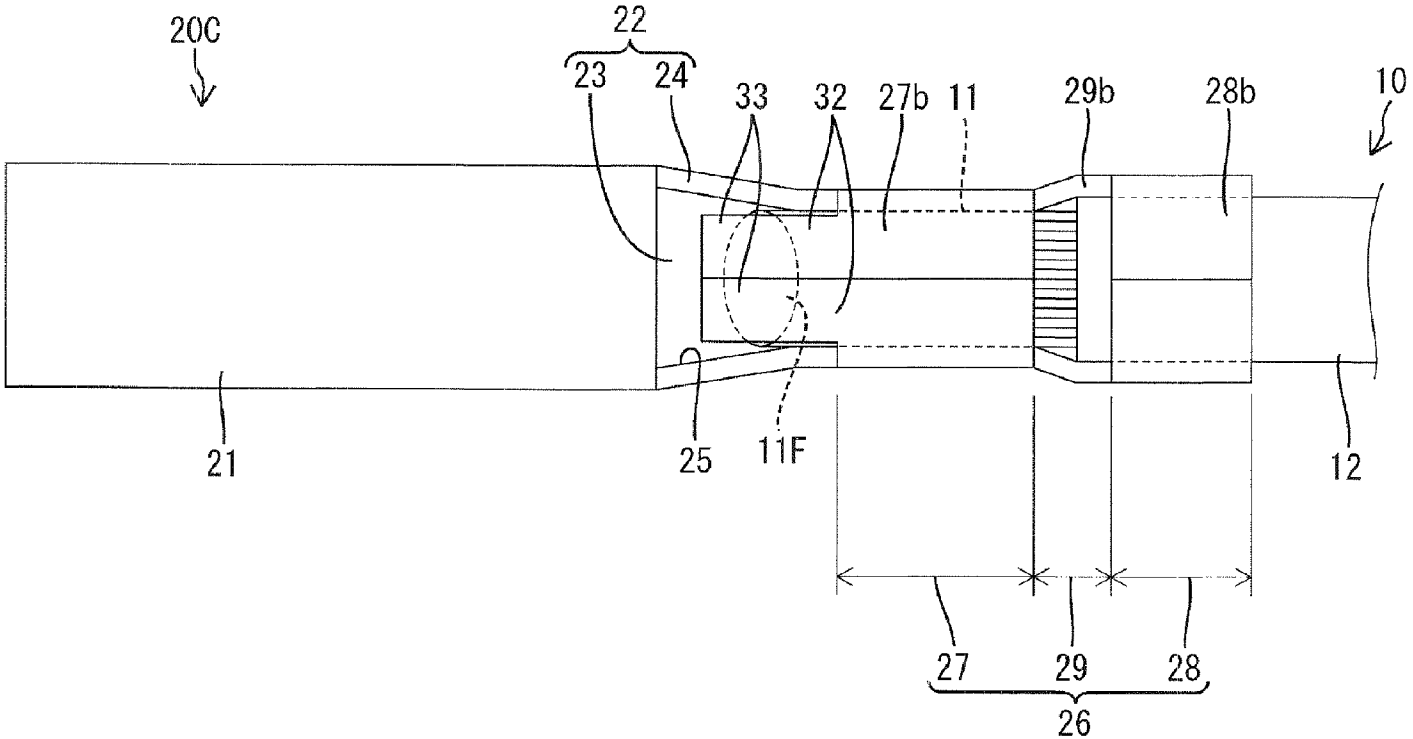
FIG. 6 is a plan view of the terminal fitting FIG. 5.
Figure 7:
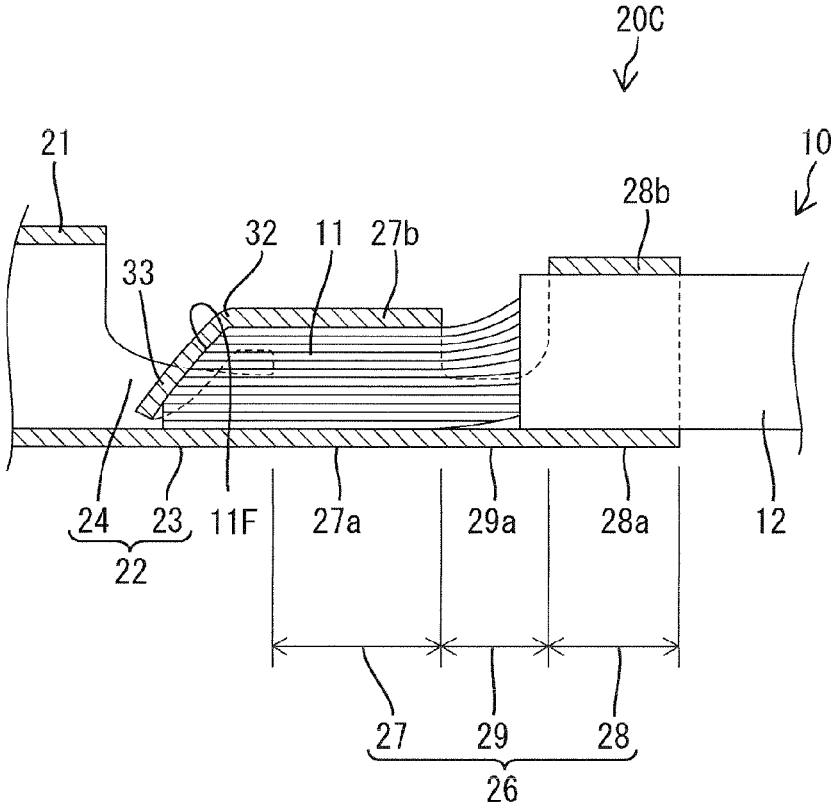
FIG. 7 is a partial section of the terminal fitting of FIG. 5.

A terminal fitting in accordance with a third embodiment of the invention is illustrated in FIGS. 5 to 7 and is identified by the numeral 20C. A terminal fitting 20C has restrictions 32 similar to the second embodiment, but unlike the first and second embodiments has no eaves. Inclinations 33 are formed at front portions of the restrictions 32 and incline forward to approach the base plate 23 of the coupling 22. A front end surface 11F of the conductor 11 is cut obliquely cut in conformity with the inclinations 33. The obliquely cut front end surface 11F of the conductor 11 contacts the inclinations 33 of the restrictions 32 from behind. The other elements of the third embodiment are the same as or similar to the first or second embodiment. These common elements are identified by the same reference numerals, but are not described again.

Figure 8:
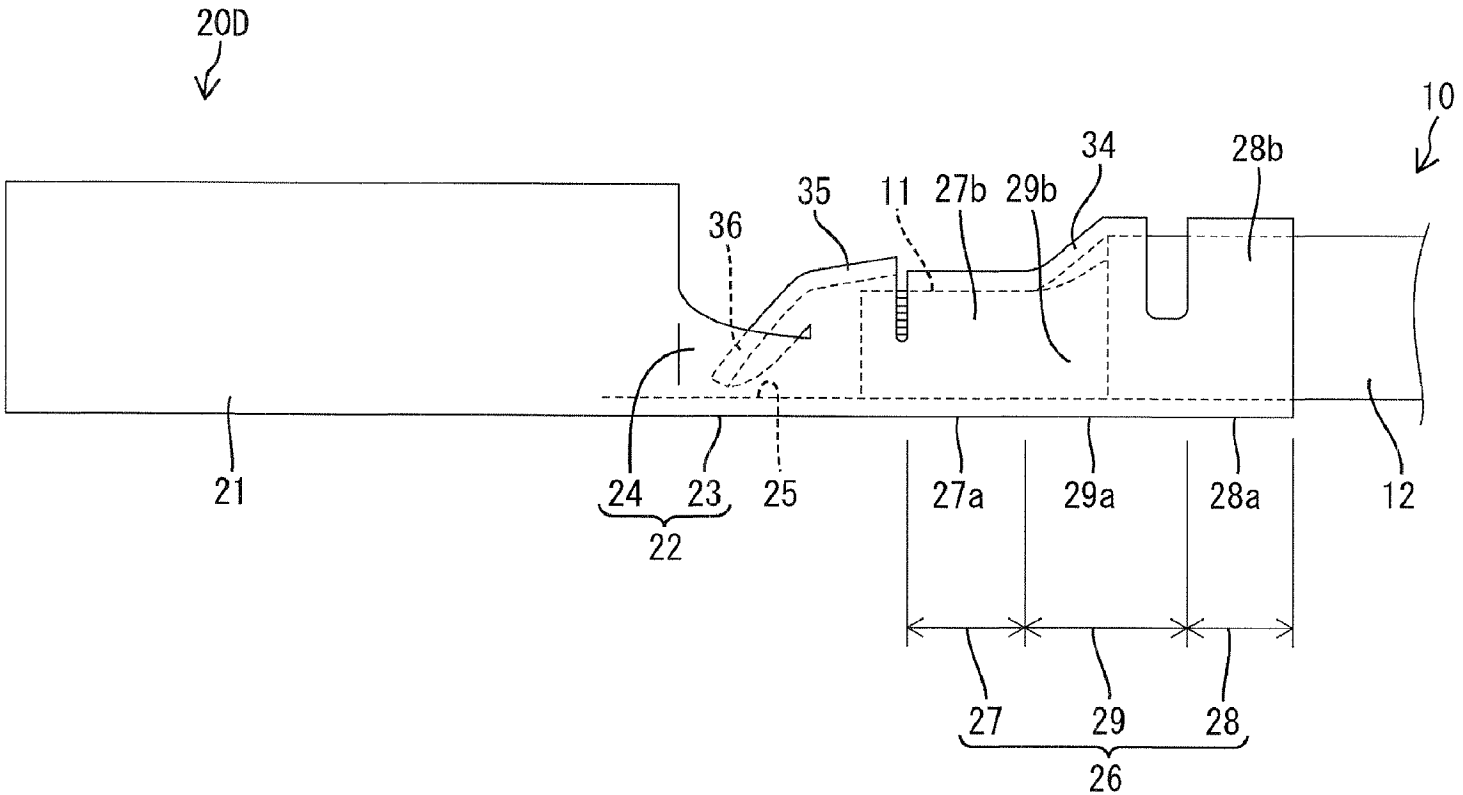
FIG. 8 is a side view of a terminal fitting according to a fourth embodiment.
Figure 9:
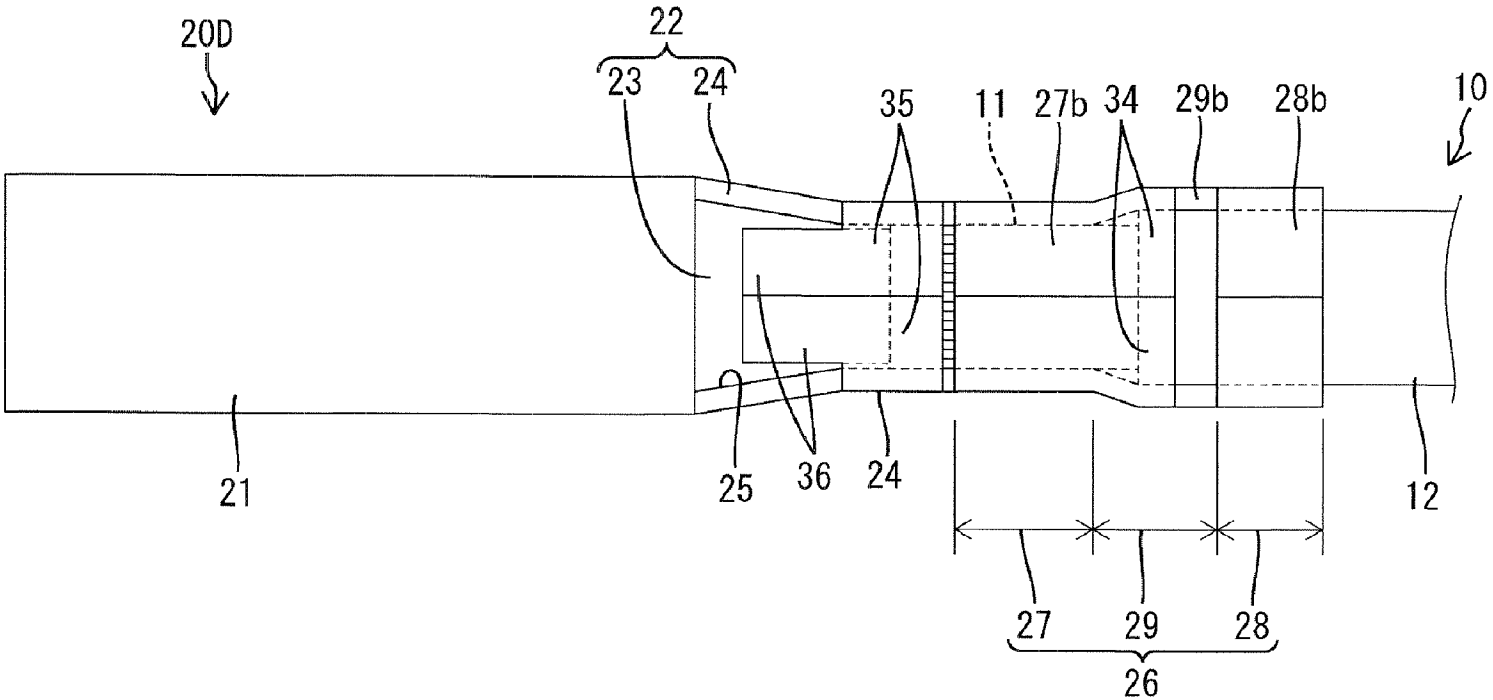
FIG. 9 is a plan view of the terminal fitting FIG. 8.

A terminal fitting in accordance with a fourth embodiment of the invention is illustrated in FIGS. 8 and 9 and is identified by the numeral 20D. The terminal fitting 20D differs from the first to third embodiments with respect to the restrictions 35 and is formed with eaves 34 as in the second embodiment. The restrictions 35 of the fourth embodiment are unitary to left and right side walls 24 of the coupling 22. Inclinations 36 are formed at the front end regions of the restrictions 35 and incline forward to approach the base plate 23 of the coupling 22 toward the front. The inclinations 36 are in an accommodation space 25 of the coupling 22 and are located to at least partly cover the conductor 11 from front. Rear portions of the lateral edges of the restrictions 35 are continuous with the standing edges of the side walls 24, but front portions of the lateral edges of the restrictions 35 are not directly continuous with crimping pieces 27*b* of a wire barrel 27. Other elements of the fourth embodiment are the same as or similar to the first or second embodiment. These common elements are identified by the same reference numerals, but are not described again.

The following modes can also be included in the technical scope of the invention described in the first to fourth embodiments.

The restrictions are unitary to the terminal fitting in the first to fourth embodiments. However, they may be parts separate from the terminal fitting.

The restrictions of the second to fourth embodiments may be continuous with both the wire barrel and the coupling as in the first embodiment.

The eaves of the second to fourth embodiments may be continuous with the insulation barrel as in the first embodiment.

The eaves of the first embodiment may not be directly continuous with the insulation barrel as in the second embodiment.

The restrictions of the first embodiment need not be directly continuous with the coupling as in the second and third embodiments.

The mode of forming the eaves of the first, second and fourth embodiments is also applicable to the third embodiment.

The restrictions of the first to third embodiments need not be directly continuous with the wire barrel, as in the fourth embodiments.

The mode of the restrictions of the third embodiment held in contact with the front end surface of the conductor is also applicable to the first, second and fourth embodiments.

The mode of the third embodiment in which the front end surface of the conductor is oblique with respect to an axial line of the wire is also applicable to the first, second and fourth embodiments.

Although the female terminal fitting with the connecting portion in the form of a rectangular tube is described in the first to fourth embodiments, the invention also is applicable to female terminals having a connecting portion of a different shape and/or to a male terminal fitting with a connecting portion having a narrow and long tab.

Figure 10:
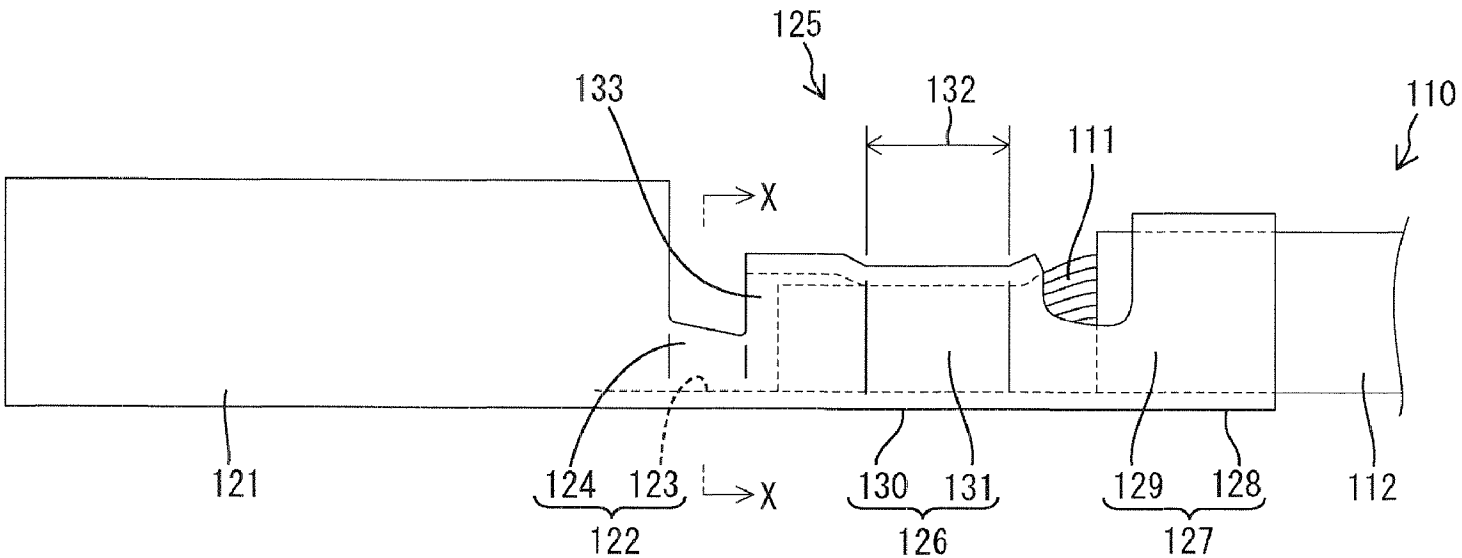
FIG. 10 is a side view of a terminal fitting according to a fifth embodiment.
Figure 11:
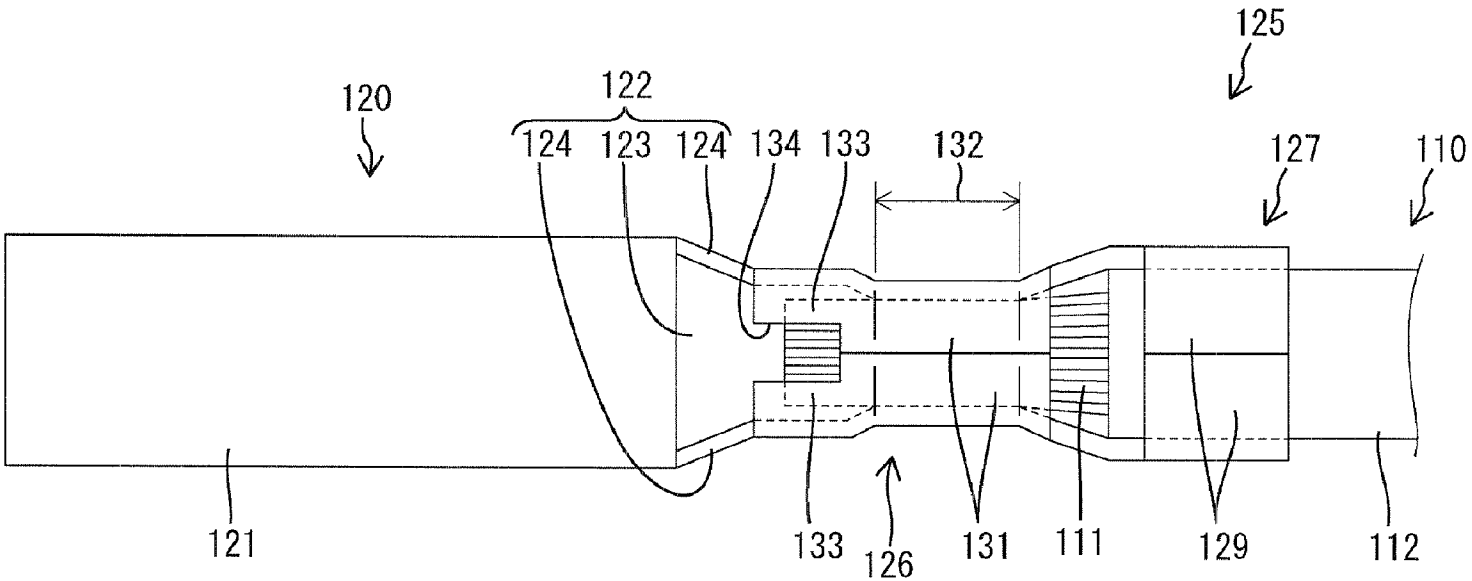
FIG. 11 is a plan view of the terminal fitting of FIG. 10.
Figure 12:
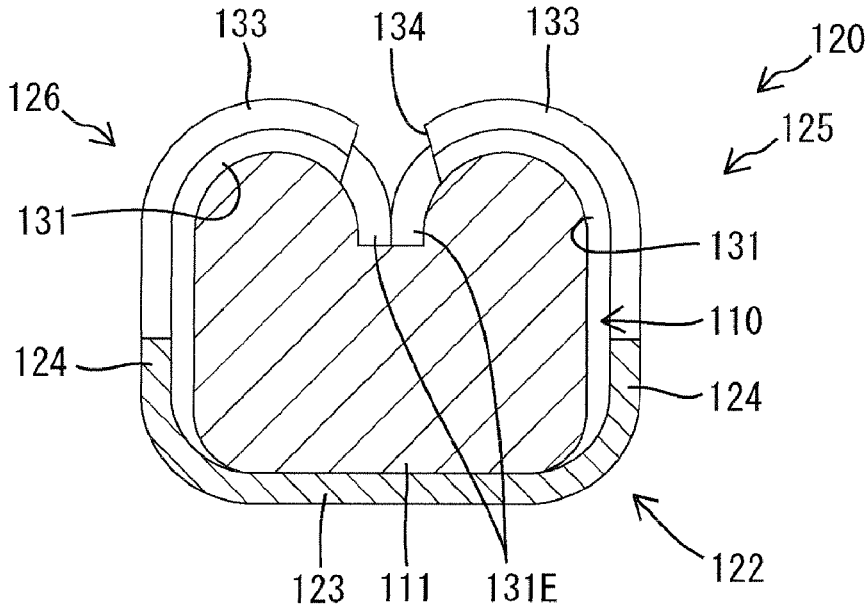
FIG. 12 is a section along X-X of FIG. 10.

A fifth embodiment of the invention relates to a wiring harness that has wires and terminal fittings, such as the wire 110 and terminal fitting 120 illustrated in FIGS. 10 to 12. The terminal fitting 120 that connected electrically with a front end portion (left end in FIGS. 10 and 11) of the wire 110. The wire 110 comprises a conductor 111 formed by twisting thin conductive wires and an insulation coating 112 surrounding the conductor 111. The insulation coating 112 is removed beforehand to expose a front end portion of the conductor 111 as preparation for connection with a terminal fitting 120. The conductor 111 is copper, a material having higher rigidity than copper (e.g. aluminum) or a material having lower electrical conductivity than copper (e.g. aluminum).

The terminal fitting 120 is a female terminal fitting formed by cutting out or punching a conductive metal plate into a specified shape and then bending, folding and/or embossing the conductive metal plate. A rectangular tubular connecting portion 121 is formed at the front end of the terminal fitting 120 and has a known form for receiving a long narrow tab of a mating male terminal (not shown). A wire crimping portion 125 is formed at a rear end region of the terminal fitting 120.

A coupling 122 extends between the rear end of the connecting portion 121 and the front end of the wire crimping portion 125. The coupling portion 122 has bottom plate 123 and side plates 124 that stand up at substantially right angles from opposite left and right sides of the bottom plate 123 to define a forwardly open space in the coupling 122.

The wire crimping portion 125 includes a wire barrel 126 substantially continuous with the rear end of the coupling 122 and an insulation barrel 127 located behind the wire barrel 126. The insulation barrel 127 has a base plate 128 and two crimping pieces 129 that extend from the opposite left and/or right edges of the base plate 128. The crimping pieces 129 can be crimped, bent or folded into connection with a front end portion of the wire 110 covered by the insulation coating 112. Upon a crimping operation, an automatic machine (not shown) called an applicator preferably is used during the crimping operation so that the insulation barrel 127 is crimped, bent or folded into connection with the wire 110 substantially as the wire barrel 126 is crimped, bent or folded into connection with the conductor 111. In a crimped state, the bottom plate 128 and the crimping pieces 129 press the wire 110 over the entire circumference, and the wire 110 is fixed to the insulation barrel 127 by a fixing force resulting from this pressing.

The wire barrel 126 has a bottom plate 130 and two crimping pieces 131 that extend from the opposite left and right sides of the bottom plate 130. The bottom plate 130 is substantially continuous with the base plate 128 of the insulation barrel 127 and the bottom plate 123 of the coupling 122. The wire barrel 126 is crimped, bent or folded into electrical connection with the conductor 111 exposed by removing the insulation coating 112 at the front end portion of the wire 110 to be fixed thereto. More particularly, the wire crimping portion 125 is set in an anvil (not shown) of an automatic machine and the conductor 111 is set on the bottom plate 130. A crimper (not shown) then is lowered to deform and wind the two crimping pieces 131 at least partly around the conductor 111. In this way, the bottom plate 130 and the crimping pieces 131 are crimped, bent or folded to at least partly surround the conductor 111.

The front end portion of the conductor 111 projects forward from the front end edges of the crimped crimping pieces 131 and extends into the coupling 122. Regions of the crimping pieces 131 that press the conductor 111 from above are curved to have an inwardly bent substantially semicircular shape (see FIG. 12) when viewed in forward and backward directions along the longitudinal directions of the conductor 111 and the terminal fitting 120. Crimpable regions 132 of the wire barrel 126 to be crimped, bent or folded by the crimper exclude the opposite front and rear ends of the crimping pieces 131, and end portions before and/or after the crimpable regions 132 define widened portions that taper obliquely out to become slightly wider than the crimpable regions 132. The widened portions of the crimpable regions 132 ensure the front and rear end edges of the inner circumferential surfaces of the crimping pieces 131 do not cut the thin metal wires of the conductor 111.

If the conductor 111 is made of aluminum, the wire barrel 126 is crimped strongly and the crimp height is set low to remove an oxide film on the outer surface. In this case, only the wire barrel 126 is crimped, bent, folded or deformed strongly. Therefore, the thin metal wires of the conductor 111 are loosened up before the wire barrel 126 and front end portions of the loosened thin metal wires are deformed to become wider. If this occurs, the widened conductor 111 projects up and out from the wire barrel 126 even if the crimp height is set low. Therefore, an effect of setting the low height of the wire barrel 126 is weakened.

Accordingly, in the fifth embodiment, the wire barrel 126 has two substantially laterally symmetrical restrictions 133 projecting toward the connecting portion 121 as means for preventing the front end portion of the conductor 111 from widening. The restrictions 133 extend forward from the front edges of the corresponding crimping pieces 131, i.e. extend substantially along the conductor 111 in a manner to cover a part of the conductor 111 before the crimpable regions 132 in the wire barrel 126 from above and are curved similar to the crimping pieces 131 as shown in FIG. 12. Formation areas of the restrictions 133 in forward and backward directions are in ranges where the front ends (left ends in FIGS. 10 and 11) of the restrictions 133 are located before the front end of the conductor 111. Further, lateral edges of the restrictions 133 are entirely continuous and flush with the upper end edges of the side plates 124 of the coupling 122 in forward and backward directions.

Formation areas of the restrictions 133 in an extending direction of the crimping pieces 133 (circumferential direction the conductor 111) are limited to ranges of the crimping pieces 131 excluding extending ends 131E. The extending ends 131E of the crimping pieces 131 are substantially in the widthwise center of the wire barrel 126 and have their outer surfaces held substantially in contact while facing down toward the base portion 123. In this way, a substantially rectangular or trapezoidal window 134 is formed between the restrictions 133. The window 134 has an open front and is located to correspond to a part of the conductor 111 in forward and backward directions and the lateral direction. The window 134 is narrower than the outer diameter of the conductor 111.

In the fifth embodiment, the crimpable regions 132 of the wire barrel 126 apply a tightening force to the front portion of the conductor 111 during the crimping operation. Thus, the front end portion of the conductor 111 may be deformed to become wider during the crimping operation. However, the wire barrel 126 has the restrictions 133 extending forward along the conductor 111 from the crimpable regions 132 of the wire barrel 126. Thus, the widening deformation of the front end portion of the conductor 111 is restricted.

Further, the restrictions 133 are cut to form the window 134. Thus, a part of the front end portion of the conductor 111 located in the coupling 122 can be seen from above the wire barrel 126 so that a proper positioning of the conductor 111 in forward and backward directions can be confirmed.

The restrictions 133 are continuous with the coupling 122 and hence are strong. Therefore, the restrictions are unlikely to deform and a widening deformation of the conductor 111 is prevented more reliably.

Figure 13:
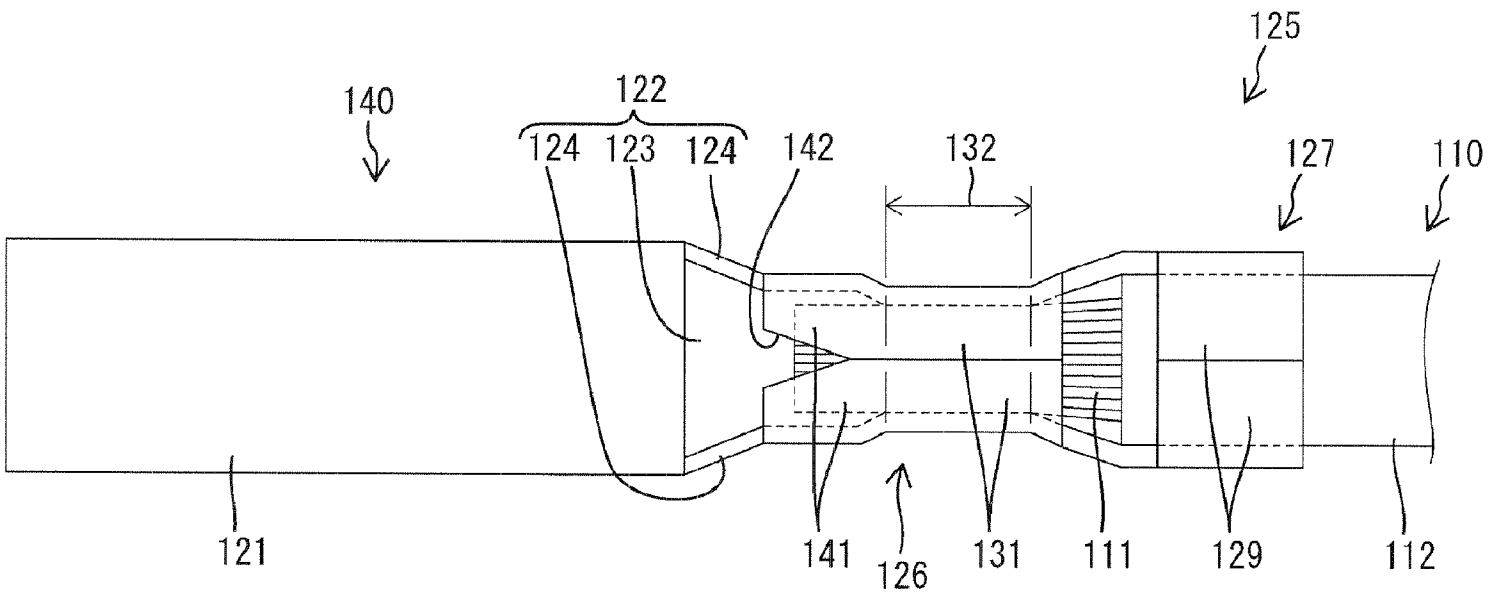
FIG. 13 is a plan view of a terminal fitting according to a sixth embodiment.

A terminal fitting in accordance with a sixth embodiment of the invention is identified by the numeral 140 in FIG. 13. The terminal fitting 140 of the sixth embodiment differs from the fifth embodiment in that a window 142 is formed by cutting off restrictions 141. Other elements are the same as or similar to the fifth embodiment. These common elements are identified by the same reference numerals, but are not described again. The window 142 of the sixth embodiment has a substantially isosceles triangular shape in a plan view so that the opening width is increased gradually toward the front. The proper position of the conductor in forward and backward directions can be detected or confirmed visually through the window 142.

The following modes of the fifth and sixth embodiments also can be included in the technical scope of the invention.

The restrictions extend forward from the front end of the conductor in the fifth and sixth embodiments. However, the front ends of the restrictions may be at the same position as the front end of the conductor in forward and backward directions or may be behind the front end of the conductor.

The restrictions extend along the upper surface of the conductor in the fifth and sixth embodiments. However, the restrictions may extend substantially along both the upper surface and side surfaces of the conductor.

Although the window is formed in the restricting portions in the fifth and sixth embodiments, the restrictions may not have the window portion.

The window has a substantially rectangular, trapezoidal or triangular shape in the fifth and sixth embodiments. However, the window may have a comb shape or semicircular shape or any other suitable shape.

The restrictions are substantially are laterally symmetrical in the fifth and sixth embodiments, but they may be laterally asymmetrical.

The restrictions are formed on both of the crimping pieces in the fifth and sixth embodiments. However, a restriction may be formed on only one of the crimping pieces.

The restrictions are continuous with the coupling in the fifth and sixth embodiments, but the restrictions and the coupling may be separated.

A female terminal fitting with a rectangular tubular connecting portion is described in the fifth and sixth embodiments. However, the invention is applicable to a female terminal fitting having a differently configured connecting portion and/or to a male terminal fitting with a connecting portion having a long narrow and tab.

Figure 14:
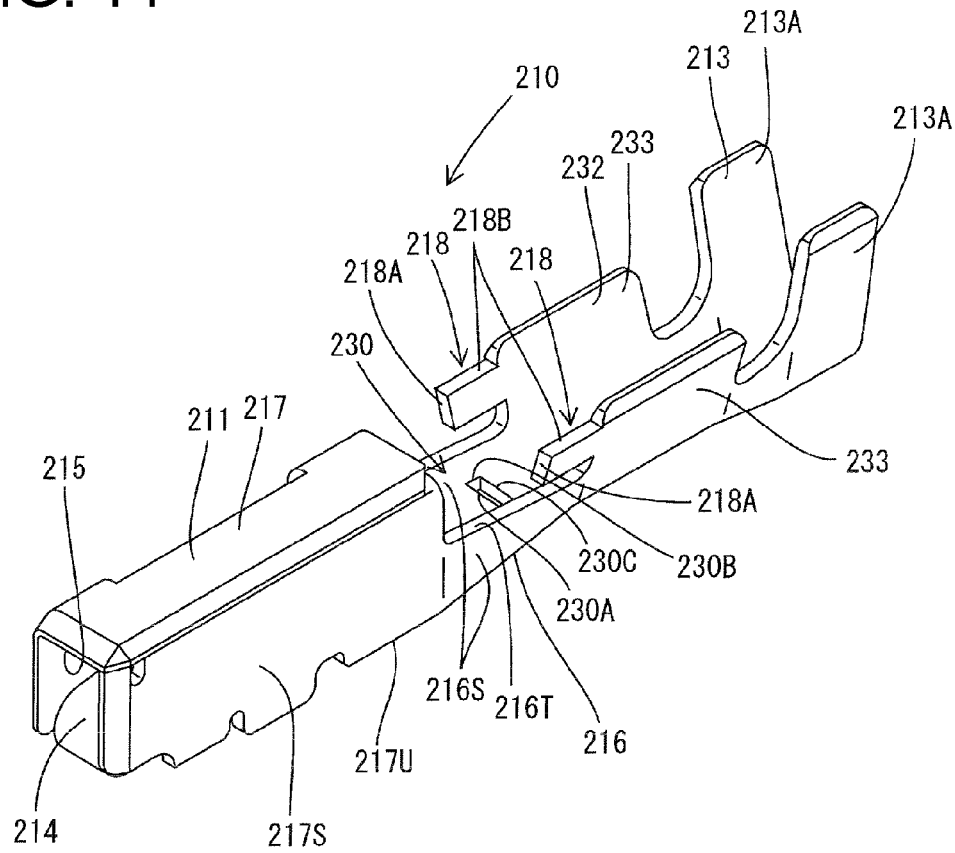
FIG. 14 is a perspective view of a terminal fitting according to a seventh embodiment.

A female terminal fitting in accordance with a seventh embodiment of the invention is identified by the numeral 210 in FIGS. 14 to 18. As shown in FIG. 14, the terminal fitting 210 includes a connecting portion 211 to be connected with a mating male terminal (not shown), a wire barrel 232 and an insulation barrel 213 successively formed behind the connecting portion 211. In the following description, upper, lower, left-lower (toward the connecting portion 211) and right-upper sides of FIG. 14 are referred to as upper, lower, front and rear sides in the respective constituent members. The front side end is to be connected with the mating terminal fitting.

The connecting portion 211 defines a rectangular tube that is long in forward and backward directions and includes a resilient contact piece 214 therein. A tab (not shown) of a mating male terminal can be inserted through an opening 215 in the front end for contacting the resilient contact piece 214.

A base plate 216 is provided behind and adjacent to the connecting portion 211 and an end portion of a wire 220 can be placed therein.

The base plate 216 is long in forward and backward directions and extends back from a lower wall 217U at a lower side of a surrounding wall 217 of the connecting portion 211. Lateral walls 216S are bent up at substantially right angles from the bottom plate 216 and extend in a longitudinal direction. The front ends of the opposite lateral walls 216S are continuous with side walls 217S of the surrounding wall 217 of the connecting portion 211. Upper edges 216T of the lateral walls 216S align with the vertical center of the connecting portion 211.

Figure 15:
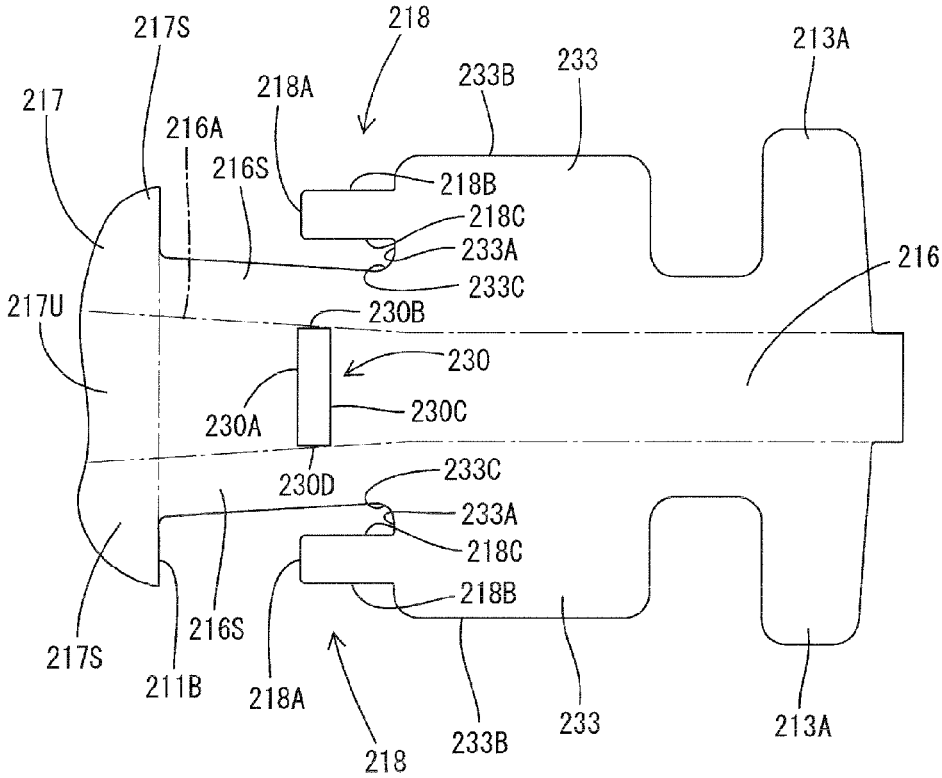
FIG. 15 is a partial development view of the terminal fitting of FIG. 14.
Figure 16:
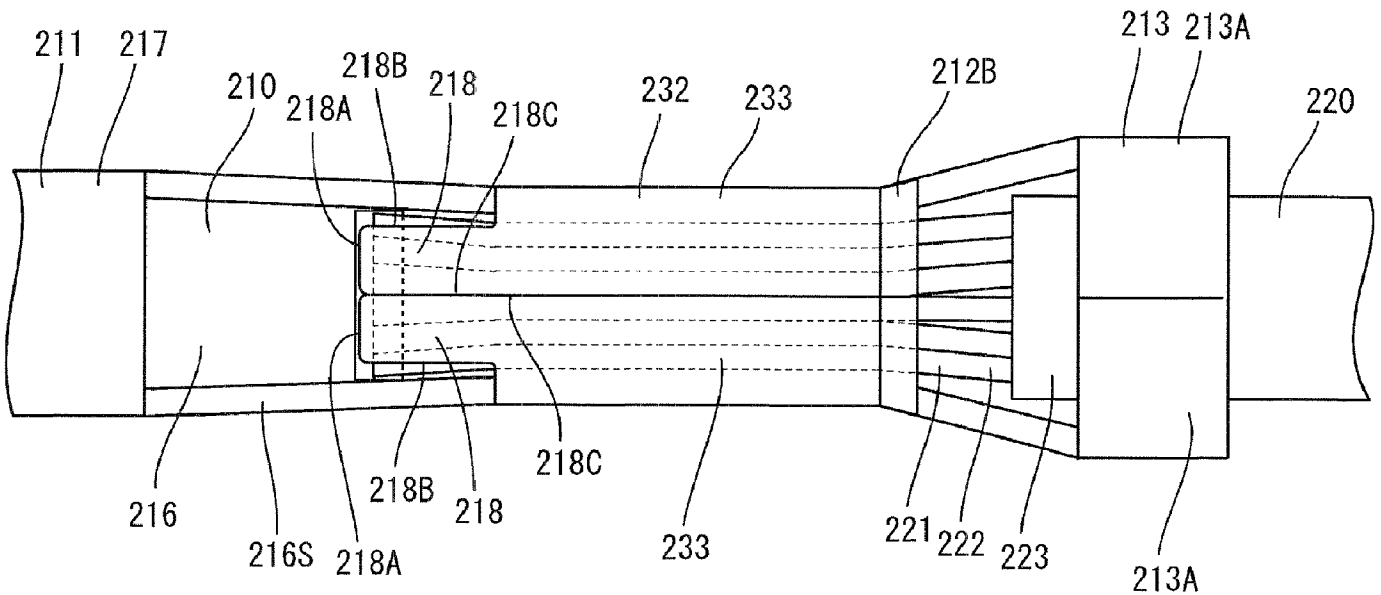
FIG. 16 is a partial plan view of the terminal fitting of FIG. 14.

The wire barrel 232 distanced back from the connecting portion 211 by a specified distance. The wire barrel 232 is to be crimped, bent or folded into connection with an exposed conductive core 222 projecting from an end of the insulation coating 223 in an end portion of the wire 220 placed on the bottom plate 216. The core 222 is formed by twisting a plurality of thin metal wires similar to the first to sixth embodiments. In a development shape of the wire barrel 232, two crimping pieces 233 project laterally from the opposite lateral sides of the bottom plate 216 as shown in FIG. 15. The crimping pieces 233 are provided at substantially the same positions in forward and backward directions or are overlapped in forward and backward directions. Thus, as shown in FIG. 14, the crimping pieces 233 face each other before being crimped into connection with the wire 220. The wire barrel 232 is crimped, bent or folded so that the projecting ends of the crimping pieces 233 are bent toward the bottom plate 216 and bite into the core 222.

The insulation barrel 213 is spaced back from the wire barrel 232 and is configured to be crimped, bent, folded or deformed into connection with the insulation coating 223 of the wire 220 placed on the base plate 216. Similar to the wire barrel 232, two crimping pieces 213A project laterally from the opposite sides of the base plate 216 during a manufacturing stage where the insulation barrel 213 is flat, as shown in FIG. 15. The crimping pieces 313A are provided at substantially the same positions in forward and backward directions or overlap in forward and backward directions. Both crimping pieces 213A face each other before being crimped into connection with the wire 220, as shown in FIG. 14.

Restrictions 218 are disposed before the crimping pieces 233 of the wire barrel 232 and project toward the connecting portion 211 for restricting the widening or deformation of the core 222.

As shown in FIG. 15, the restrictions 218 are rectangles that are long in forward and backward directions and project forward from front ends 233A of the crimping pieces 233. The thickness of the restrictions 218 preferably is substantially equal to the thickness of the crimping pieces 233.

The length of the restrictions 218 in forward and backward directions is set so that leading ends 218A of the restrictions 218 are at an intermediate position between a rear end 211B of the connecting portion 211 and the front ends 233A of the crimping pieces 233, and the restrictions 218 are at intermediate positions of projecting parts of the crimping pieces 233 between base ends 233C of the crimping pieces 233 and projecting ends 233B of the crimping pieces 233 in a width direction.

At least one window 230 penetrates the base plate 216 and enables the leading end of the core 222 to be seen from below.

The window 230 vertically penetrates the bottom plate 216 and has a rectangular shape long in the width direction (vertical direction in FIG. 15), and the width of the widow 230 between widthwise ends 230B, 230D is defined between parts of the bottom plate 216 to be bent substantially at right angles (between positions 216A indicated by dashed-dotted line of FIG. 15).

The window 230 is at a position closer to the connecting portion 211 than the front ends 233A of the crimping pieces 233 in forward and backward directions, i.e. located between the rear end 211B of the connecting portion 211 and the front ends 233A of the crimping pieces 233. More specifically, the position of the window 230 in forward and backward directions is set such that a surface 230A of the window 230 toward the connecting portion 211 is substantially at the position of the leading ends 218A of the restricting portions 218 and/or a surface 230C thereof toward the crimping pieces 233 is located in an intermediate position between the restrictions 218.

The wire 220 may be an aluminum wire 220 with a core 222 formed by twisting a multitude of thin metal wires 221 made of aluminum or aluminum alloy. The core 222 is covered by the insulation coating 223. The end portion of the aluminum wire 220 has the insulation coating 223 removed to expose the core 222.

The end portion of the aluminum wire 220 is inserted on the bottom plate 216 from the insulation barrel 213 to the wire barrel 232. At this time, the end portion of the aluminum wire 220 is at a position where the end portion of the insulation coating 223 is between the crimping pieces 213A of the insulation barrel 213, the exposed part of the core 222 is between the crimping pieces 233 of the wire barrel 232 and the leading end of the core 222 projects forward from the wire barrel 232.

The insulation barrel 213 and the wire barrel 232 then successively are crimped, bent, folded or deformed using an unillustrated anvil and crimper. The crimped insulation barrel 213 winds around the insulation coating 223.

The crimper for crimping the wire barrel 232 includes a crimping section for pressing and deforming the crimping pieces 233 into connection with the core 222 and a stand-up restricting section for pressing the restrictions 218 to prevent the restrictions 218 from standing up. The crimping section and the stand-up restricting section of the crimper are provided integrally, and surfaces facing the anvil have differently shaped recesses.

The recess of the crimping section of the crimper has two arcuate surfaces arranged substantially side by side for bending the projecting ends of the crimping pieces 233 so that the ends of the crimping pieces 233 bite into the core 222 when the crimper is pressed toward the anvil. The recess of the crimping section of the crimper is shaped so that the wire barrel 232 can be crimped to compress the core 222.

The crimper is pressed toward the anvil to a position where the crimping section crimps the wire barrel 232 to compress the core 222 by a specified amount. A compression amount of the core 222 is set so that a contact load between the wire barrel 232 and the core 222 increases to a sufficient level to reduce contact resistance and a sufficient fixing force can be obtained. The core 222 is made of aluminum or aluminum alloy in the seventh embodiment. Thus, a higher compression is set as compared with the case where the wire barrel 232 is crimped into connection with a conventional core made of copper or copper alloy in order to destroy an oxide film of the core 222.

The recess of the stand-up restricting section of the crimper is shaped so that the restrictions 218 can be bent to positions above the core 222 while the restrictions 218 formed unitary to the crimping pieces 233 are prevented from standing up when the crimper is pressed toward the anvil. Further, the core 222 tries to move up as the wire barrel 232 is crimped. However, the recess of the stand-up restricting section of the crimper is shaped so that the restrictions 218 cannot stand up when pressed from below by the leading end of the core 222. Additionally, a pressing force is exerted when the core 222 is pressed by the restrictions 218 located above the core 222 to prevent the leading end of the core 222 that projects forward from the restrictions 218 from moving up and away from the base plate 216.

The crimping pieces 233 are pressed by the crimping section of the crimper. Thus, the projecting ends of the crimping pieces 233 are bent down toward the base plate 216 and start biting into the upper surface of the core 222 at substantially widthwise central positions. The restrictions 218 are bent toward the side of the core 222 opposite to the base plate 216 and the stand-up restricting section of the crimper prevents the restrictions 218 from standing up. Thus, the restrictions 218 are located on the upper side of the core 222 and face the base plate 216 (see FIGS. 16 and 18). A crimping force of the wire barrel 232 acts to bend up a leading part of the core 222 that projects forward from the wire barrel 232. However, the restrictions 218 on the upper side of the leading end of the core 222 prevent the core 222 from bending up. In this way, the terminal fitting 210 is connected with the aluminum wire 220 without the leading end of the core 222 being bent up.

A rear part of the wire barrel 232 widens toward the rear to form a bell mouth or widened portion 212B. The bell mouth 212B moderately changes the cross section of a part of the core 222 to be crimped by the wire barrel 232. Thus, a concentration of a stress resulting from the vibration of the wire 220 or the like can be alleviated. No bell mouth 212B is provided at the front end of the wire barrel 232 because this part is not influenced much by the vibration of the wire 220 and the like since the wire 220 is crimped behind this part by the wire barrel 232. Hence, the absence of a bell mouth it is not disadvantageous.

Figure 17:
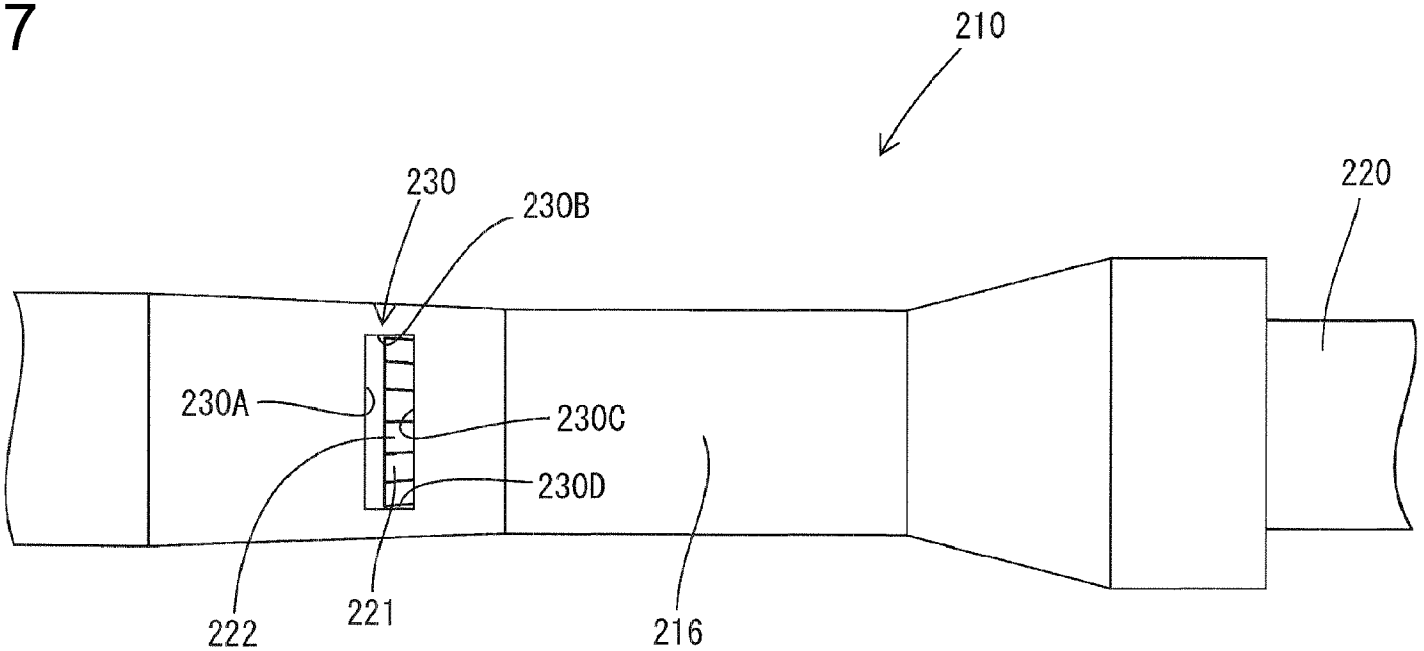
FIG. 17 is a partial bottom view of the terminal fitting of FIG. 14.
Figure 18:
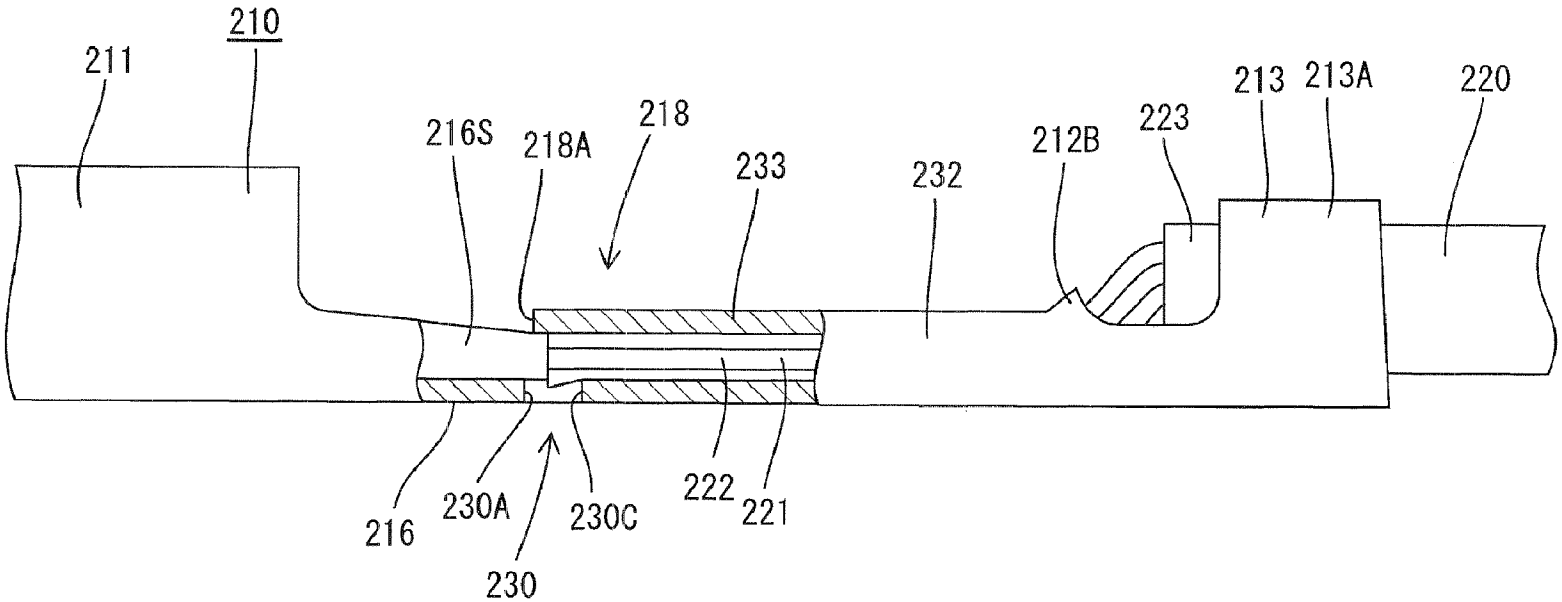
FIG. 18 is a side view partly in section of the terminal fitting of FIG. 14.

The window 230 shown in FIG. 17 enables the core 222 to be seen from below the bottom plate 216 after the wire barrel 232 is crimped, bent, folded or deformed into connection with the core 222. Visibility of the core 222 through the window 230 indicates that the wire barrel 232 is crimped, bent or folded in a state where the leading end of the core 222 projects forward from the crimping pieces by a specified projecting length. In other words, the wire barrel 232 is crimped at a position where the wire barrel 232 is crimped over the entire length of the core 222 in forward and backward directions. On the other hand, an inability to see the core 222 indicates that the core 222 does not project sufficiently from the crimping pieces. In other words, the wire barrel 232 is not crimped at the proper position. In this case, a product is removed as a defective product since there is a possibility of incomplete crimping.

The restrictions 218 are unitary with the front edges of the crimping pieces and are above the end portion of the wire 220. Thus, the restrictions 218 suppress an upward widening movement of the end portion of the wire 220 away from the base plate 216 when the crimping pieces 233 are crimped. Further, the disposition of the restricting portions 218 above the core 222 as the crimping pieces 233 are crimped reduces the number of operation steps as compared with the case of separately performing the operation of crimping the crimping pieces 233 and the operation of bending the restrictions 218.

The connected state of the wire 220 cannot be confirmed visually form above the terminal fitting 210 since the leading end of the wire 220 is hidden by the restrictions 218. However, the window 230 in the base plate 216 enables the leading end portion of the wire 220 to be seen from below the terminal fitting 210 to confirm the connected state of the wire 220.

The restriction 218 is provided on each of the crimping pieces 233. Thus, an upward movement is less likely than if only on one crimping piece 233 is provided and the load on the connected part can be reduced.

The following modes also can be included in the technical scope of the seventh embodiment of the invention.

The terminal fitting 210 of the seventh embodiment has two crimping pieces 233. However, the invention also is applicable to a terminal fitting including only one crimping piece to be wound around a core.

The restriction 218 is provided on both crimping pieces 233 in the seventh embodiment. However, the restriction may be provided only on one of the crimping pieces. In this case, the restriction has a size that is the sum of the sizes of the two restrictions 218 of the seventh embodiment and this restriction may be provided on either of the crimping pieces.

The two crimping pieces 233 are provided at the same positions in forward and backward directions in the seventh embodiment. However, the invention also is applicable, for example, to a terminal fitting with crimping pieces displaced in forward and backward directions. At this time, a restriction may be provided unitarily on the front crimping pieces.

The terminal fitting 210 is connected with the aluminum wire 220 in the seventh embodiment. However, the terminal fitting 210 may be connected with an end portion of a wire including a core made of copper or copper alloy. In this case, effects similar to those described above can be obtained.

The window 230 is rectangular. However, the window may have another shape, such as a trapezoidal, a polygonal, circular or elliptical shape provided that the leading end of the core can be seen therethrough.

The window 230 is formed in the central part of the bottom plate 216 and the leading end portion of the core is seen therethrough from below. However, a window may penetrate the side edge portion 216S of the bottom plate 216 in the width direction and the leading end portion of the core may be seen from a lateral side.

Figure 19:
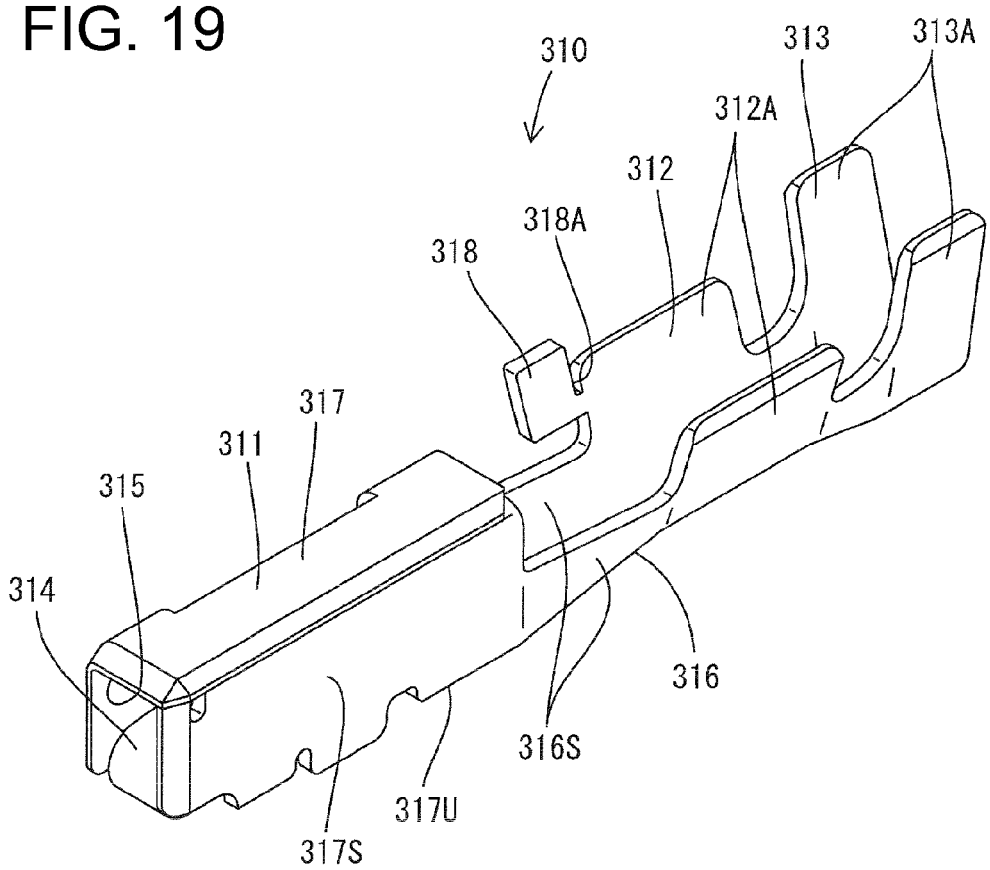
FIG. 19 is a perspective view of a terminal fitting according to an eighth embodiment.

An eighth embodiment of the invention is described with reference to FIGS. 19 to 22. In the eighth embodiment, the invention is applied to a female terminal fitting 310, but it may equally be applied to a male terminal fitting. The terminal fitting 310 is formed by bending, folding and/or embossing a conductive metal piece punched or cut out into a specified development shape from a flat metal plate using a press forming machine. The terminal fitting 310 includes a connecting portion 311 to be connected with a mating male terminal (not shown). A wire barrel 312 and an insulation barrel 313 are formed successively behind the connecting portion 311. In the following description, upper, lower, left-lower (toward the connecting portion 311) and right-upper sides of FIG. 19 are referred to as upper, lower, front and rear sides.

The connecting portion 311 is bent into a substantially rectangular tube long in forward and backward directions and includes a resilient contact piece 314 therein. A tab (not shown) of a mating male terminal is inserted through a front opening 315 for contacting the resilient contact piece 314.

A base plate 316 is provided behind the connecting portion 311 and an end portion of a wire 320 can be placed on the base plate 316. The base plate 316 is long in forward and backward directions and extends back from a lower wall 317U at a lower side of a surrounding wall 317 of the connecting portion 311. Lateral walls 316S are bent up from opposite sides of the bottom plate 316 and extend longitudinally along an extending direction of the bottom plate 316. The front ends of the opposite lateral walls 316S are substantially continuous with side walls 317S of the surrounding wall 317 of the connecting portion 311 that stand up from the opposite sides of the lower wall 317U. Upper edges of the lateral walls 316S of the bottom plate 316 align substantially with the vertical center of the connecting portion 311.

Figure 20:
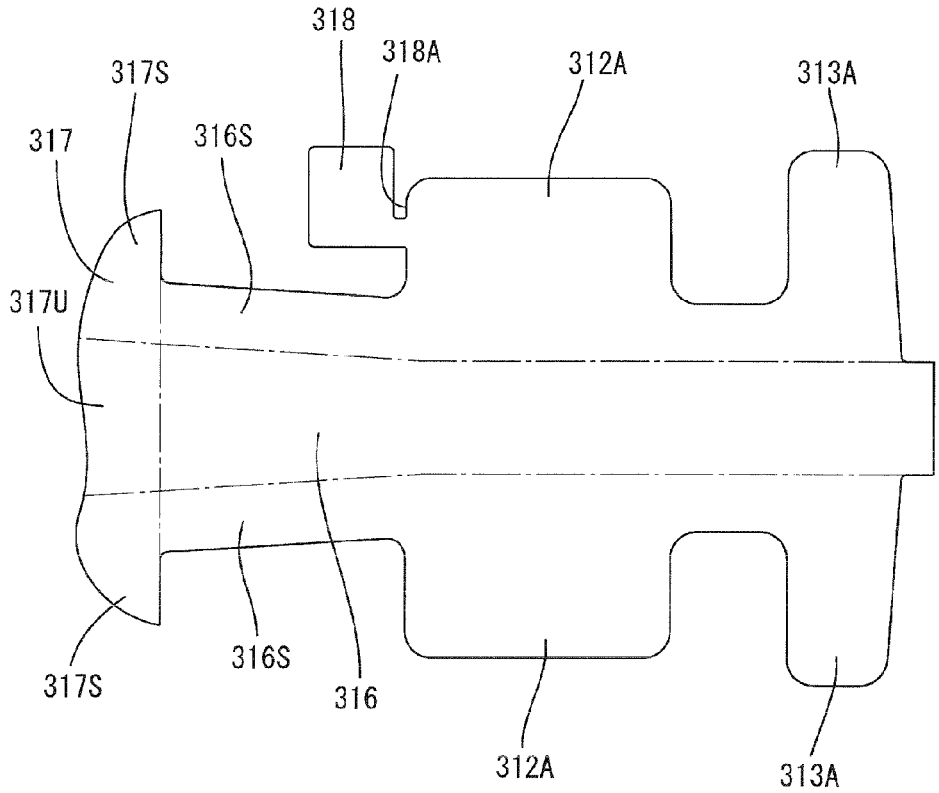
FIG. 20 is a partial development view of the terminal fitting of FIG. 19.
Figure 21:
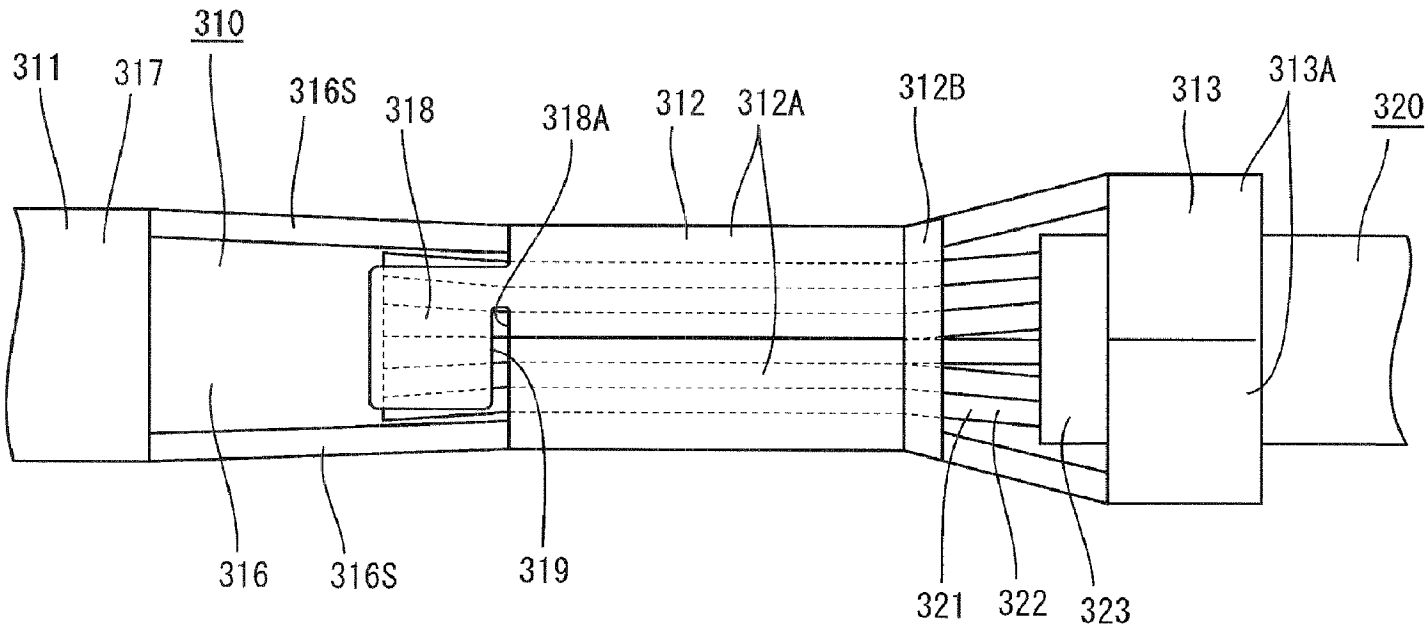
FIG. 21 is a partial plan view of the terminal fitting of FIG. 19.
Figure 22:
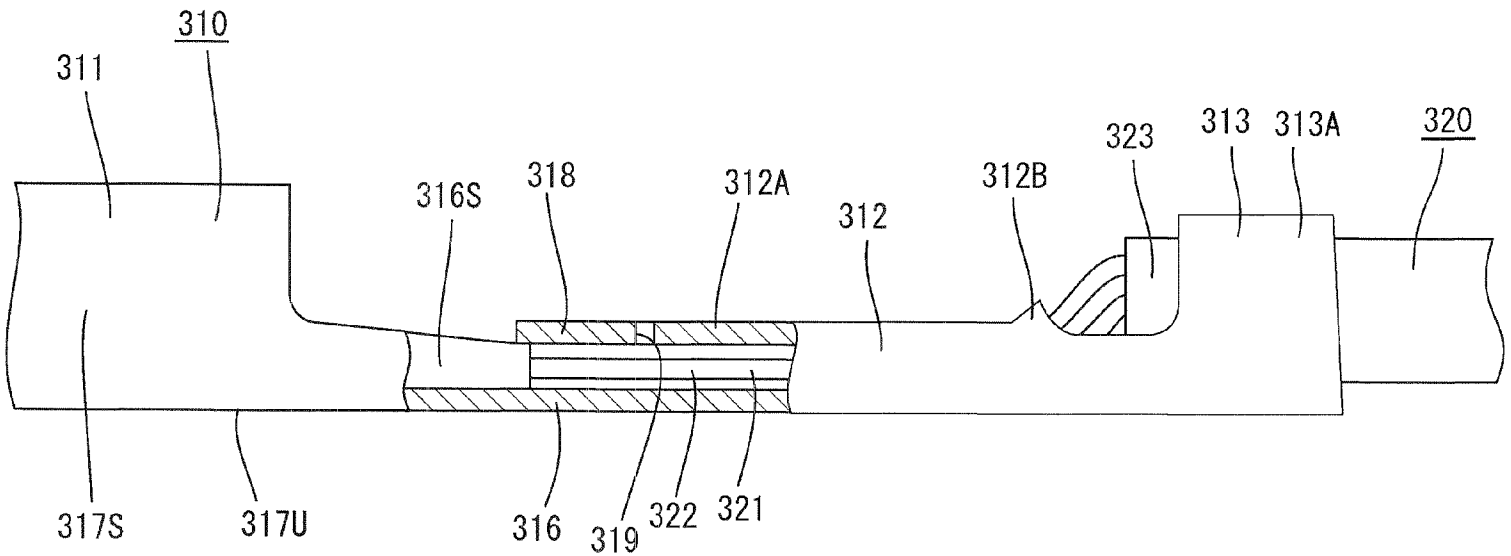
FIG. 22 is a side view partly in section of the terminal fitting of FIG. 19.

The wire barrel 312 is spaced back from the connecting portion 311 and is formed to be crimped, bent, folded or deformed into connection with a conductive core 322 projecting from an end of the insulation coating 323 of the wire 320 placed on the bottom plate 316. The core 322 is formed by twisting thin metal wires similar to the first to seventh embodiments. In a development shape of the wire barrel 312, two crimping pieces 312A project laterally from the opposite lateral sides of the bottom plate 316, as shown in FIG. 20. The crimping pieces 312A are at the same positions in forward and backward directions or overlap along the forward and backward directions. As shown in FIG. 19, the crimping pieces 312A face each other before being crimped, bent or folded into connection with the wire 320. However, the wire barrel 312 is crimped, bent or deformed to bite into the core 322 by having the projecting ends of the pair of crimping pieces 312A bent toward the base plate 316.

The insulation barrel 313 is spaced back from the wire barrel 312 and is configured to be crimped, bent or folded into connection with the insulation coating 323 of the wire 320 placed on the bottom plate 316. Two crimping pieces 313A project laterally from the opposite sides of the bottom plate 316 in the development state shown in FIG. 20. As shown in FIG. 19, the crimping pieces 313A face each other before being crimped.

A restriction 318 is provided unitarily on the front side of one of the crimping pieces 312A of the wire barrel 312 for restricting the widening deformation of the leading end side of the core 322. The restriction 318 has a substantially rectangular shape slightly longer in a projecting direction of the crimping piece 312A and stands up in substantially the same direction as the crimping pieces 312A before the wire barrel 312 is crimped (see FIG. 19). One longitudinal end of the restriction 318 is connected with the front edge of the crimping piece 312A and the other longitudinal end thereof projects more laterally than the projecting end of the crimping piece 312A (see FIG. 20). The restriction 318 is connected with an intermediate part of the crimping piece 312A excluding a projecting end portion and an end portion toward the bottom plate 316. A connected part of the crimping piece 318 and the crimping piece 312A has a substantially rectangular shape wider in the projecting direction of the crimping piece 312A, and is small as compared with the main part of the restriction 318.

A window 318A is formed between the restriction 318 and the crimping piece 312A from which the restriction 318 extends (see FIG. 20). The restriction 318 projects laterally at a position displaced forward from the crimping piece 312A by as much as the window 318A. A window 319 is formed between the restriction 318 and the crimping piece 312A when the crimping piece 312A is connected with the wire 320 (see FIG. 21). The window 318A is a part of the window 319. The window 319 extends in the short direction of the bottom plate 316 along the front edge of the crimping piece 312A that has been crimped into connection with the core 322. The front edges of the crimping pieces 312 and the rear edge of the restriction 318 are substantially parallel.

The wire 320 has a core 322 formed by twisting strands of wires 321 made of aluminum or aluminum alloy. The core 322 is covered by the insulation coating 323. However an end portion of the aluminum wire 320 has the insulation coating 323 removed to expose the core 322.

The end portion of the aluminum wire 320 is placed on the bottom plate 316 so that the end portion of the insulation coating 323 is between the crimping pieces 313A of the insulation barrel 313, the exposed part of the core 322 is between the crimping pieces 312A of the wire barrel 312 and the leading end of the core 322 projects forward from the wire barrel 312.

Subsequently, the insulation barrel 313 and the wire barrel 312 are crimped successively by using unillustrated anvil and crimper. The insulation barrel 313 is crimped to wind at least partly around the insulation coating 323.

The crimper for crimping the wire barrel 312 includes a crimping section for pressing and crimping the crimping pieces 312A into connection with the core 322 and a stand-up restricting section for pressing the restriction 318 to prevent the restriction 318 from standing up. The crimping section and the stand-up restricting section of the crimper are provided unitarily, and surfaces thereof facing the anvil have differently shaped recesses.

The recess of the crimping section of the crimper has two side by side arcuate surfaces arranged for bending the projecting ends of the crimping pieces 312A to cause them to bite into the core 322 when the crimper is pressed toward the anvil. The recess of the crimping section of the crimper is shaped so that the wire barrel 312 can be crimped to compress the core 322.

The crimper is pressed toward the anvil to a position where the crimping section crimps the wire barrel 312 to compress the core 322 by a specified amount. A compression amount of the core 322 is set such that a contact load between the wire barrel 312 and the core 322 increases to a sufficient level to reduce contact resistance and to obtain a sufficient fixing force. The core 322 preferably is made of aluminum or aluminum alloy and the crimping preferably should destroy an oxide film of the core 322. Hence, a higher compression is set as compared with the case where the wire barrel 312 is crimped into connection with a core made of copper or copper alloy.

The recess of the stand-up restricting section of the crimper is shaped so that the restriction 318 is bent to be located above the core 322 while the restriction 318 formed unitary with the crimping pieces 312A is prevented from standing up when the crimper is pressed toward the anvil. Further, the recess of the stand-up restricting section of the crimper is shaped so that the restriction 318 cannot stand up when pressed from below by the leading end of the core 322 that is urged up as the wire barrel 312 is crimped, bent or folded. The disposition of the restriction 318 above the core 322 substantially prevents the part of the core 322 forward of the restriction 318 from moving up in response to the crimping forces.

The crimping pieces 312A are pressed by the crimping section of the crimper and the projecting ends of the crimping pieces 312A before the connected part with the restriction 318 are bent down toward the bottom plate 316 and start biting into the upper surface of the core 322 at widthwise intermediate positions. The restriction 318 is bent toward the upper side of the core 322 and the deflection restricting section of the crimper prevents the restriction 318 from standing up (see FIGS. 21 and 22). A crimping force of the wire barrel 312 acts to bend up a part of the core 322 forward from the wire barrel 312. However, the restriction 318 on the upper side of the leading end of the core 322 prevents the core 322 from being deformed away from the base plate 316. In this way, the terminal fitting 310 is connected with the stiffer aluminum wire 320 without the leading end of the core 322 being bent up.

With the wire barrel 312 connected with the core 322, a substantially longitudinal half of the restriction 318 projects forward of the crimping piece 312A that has no restriction 318 to press a widthwise middle part of the core 322 from above.

A rear end portion of the wire barrel 312 is widened toward the rear end to form a bell mouth 312B. The bell mouth 312B causes the cross section of a part of the core 322 to be fastened by the wire barrel 312 to be changed moderately. Thus, the concentration of a stress resulting from the vibration of the wire 320 or the like can be alleviated. No bell mouth 312B is provided at the front end of the wire barrel 312 in the eighth embodiment. It has been recognized that this part is not influenced by the vibration of the wire 320 since the wire barrel 312 is crimped behind this part. Therefore, the absence of a bell mouth 312B at the front end of the wire barrel has no disadvantage.

An observation is made after the wire barrel 312 is crimped, bent or folded into connection with the core 322 to determine whether the core 322 can be seen through the window 319 between the restriction 318 and the wire barrel 312. The wire barrel 312 has been crimped, bent or folded at a proper position if the core 322 can be seen through the window 319. The wire barrel 312 is not crimped at the proper position if the core 322 cannot be seen.

The restriction 318 is provided unitarily on the front edge of the crimping piece 312A and is above the end portion of the wire 320 when the crimping pieces 312A are crimped for suppressing an upward movement of the end portion of the wire 320. Accordingly, crimping, bending or folding the crimping pieces 312A into connection with the exposed portion of the core 322 near the end of the wire 320 prevents widening and/or deflection of the leading end of the core 322. Further, the restriction 318 is located above the core 322 as the crimping pieces 312A are crimped, bent or folded. Thus, the number of operation steps is reduced as compared with the case of separately performing the operation of crimping the crimping pieces 312A and the operation of bending the restriction 318.

The window 319 is before the crimping pieces 312A that have been crimped into connection with the wire 320. Thus, whether the leading end of the core 322 projects forward from the crimping pieces 312A can be detected visually through the window 319 from outside after the crimping pieces 312A are crimped, bent or folded into connection with the wire 320. A contact area of the crimping pieces 312A and the core 322 decreases to increase contact resistance if the crimping pieces 312A are crimped with the core 322 at a position retracted from the front ends of the crimping pieces 312A. However, whether the leading end of the core 322 projects forward from the crimping pieces 312A can be confirmed through the window 319 in the eighth embodiment, and a defective product can be removed.

The restriction 318 is connected with the middle part of the crimping piece 312A spaced from the projecting end and the end toward the bottom plate. Thus, the restriction 318 is bent more than necessary as the crimping piece 312A is crimped, bent or folded. Accordingly, upon crimping the wire barrel 312, the restriction 318 is arranged above the core 322 without being bent to bite in the core 322. In other words, the leading end of the core 322 is prevented from being bent up or unduly deflected even in the terminal fitting 310 to be crimped such that the crimping pieces 312A bite in the core 322. Further, the restriction 318 is formed on only one of the two crimping pieces 312A, a forming error upon forming the restriction 318 can be suppressed.

The illustrated terminal fitting 310 of the eighth embodiment has two crimping pieces 312A. However, the invention also is applicable to a terminal fitting with only one crimping piece to be wound around a core.

The terminal fitting 310 of the eighth embodiment has two crimping pieces 312A at substantially the same positions in forward and backward directions. However, the invention also is applicable to a terminal fitting in which a pair of crimping pieces are displaced or offset in forward and backward directions. At this time, a restriction may be provided integrally on the front crimping piece.

The restriction 318 is provided on only one crimping piece 312A in the eighth embodiment. However, restrictions may be provided on both crimping pieces.

The terminal fitting 310 is connected with the end of the aluminum wire 320 in the eighth embodiment. However, the terminal fitting 310 may be connected, for example, with an end portion of a wire with a core made of copper or copper alloy or any other conductive material.

Although the window 319 is formed along the front edge of the crimping piece 312A in the eighth embodiment, the invention is not limited to this and, for example, the window may be formed in the restriction or may be formed from the crimping piece to the restriction.

What is claimed is:

1. A terminal fitting comprising:

a connecting portion configured for connection with a mating terminal;

at least one wire barrel having a base plate extending from the connection portion and configured for receiving an end portion of a wire, and two crimping pieces standing up from the base plate configured for crimped connection with an end portion of a conductor exposed by removing an insulation coating of the wire, the conductor being connected while being surrounded by the base plate and the crimping pieces; and at least one restriction projecting from an end of the wire barrel toward the connecting portion, the restriction being connected to at least one of the crimping pieces and configured for restricting widening and deflection of a leading end of the conductor.

2. The terminal fitting of claim 1, wherein a leading end of the restriction is located before the conductor.

3. The terminal fitting of claim 1, wherein the restriction is continuous with the wire barrel.

4. The terminal fitting of claim 1, wherein a portion of the restriction is continuous with a middle part of the crimping piece that is opposed to the base plate.

5. The terminal fitting of claim 1, further comprising:

a coupling between the wire barrel and the connecting portion, the leading end of the conductor being positioned at the coupling, and the restriction being continuous with the coupling.

6. The terminal fitting of claim 1, wherein the restriction or the base plate (216) is formed with at least one window (134; 142; 230; 318A; 319) enabling a part of the conductor (111; 222; 322) to be seen.

7. The terminal fitting of claim 6, wherein the window (134; 142; 230; 318A; 319) is at a side closer to the connecting portion (121; 211; 311) than to the wire barrel (126; 232; 312).

8. The terminal fitting of claim 1, wherein the conductor and the wire barrel are made of different kinds of materials.

9. The terminal fitting of claim 1, wherein the restriction is formed to cover a leading end of the conductor.

10. A terminal fitting, comprising:

a connection portion configured for connection with a mating terminal;

at least one wire barrel configured for crimped connection with an end portion of a conductor exposed by removing an insulation coating of a wire;

at least one restriction, projecting from an end of the wire barrel toward the connecting portion and configured for restricting widening and deflection of a leading end of the conductor; and at least one insulation barrel at a side of the wire barrel opposite to the connecting portion, the insulation barrel being configured for crimped connection with the insulation coating of the wire.

11. The terminal fitting of claim 10, wherein the wire barrel is formed with at least one eave extending toward the insulation barrel to overlap with the outer circumferential surface of the insulation coating.

12. The terminal fitting of claim 11, wherein an extending end portion of the eave is continuous with the insulation barrel.

13. The terminal fitting of claim 10, wherein at least a portion of the restriction is inclined obliquely to a longitudinal direction extending from the connection portion to the wire barrel.

14. The terminal fitting of claim 1, wherein at least part of the restriction is inclined to extend obliquely toward the base plate.

* * * * *